US007883085B2

(12) United States Patent
Asada et al.

(10) Patent No.: US 7,883,085 B2
(45) Date of Patent: Feb. 8, 2011

(54) GUIDE DEVICES AND IMAGE PROCESSING APPARATUS

(75) Inventors: Tetsuo Asada, Kuwana (JP); Masatashi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/123,870

(22) Filed: May 20, 2008

(65) Prior Publication Data

US 2008/0292382 A1 Nov. 27, 2008

(30) Foreign Application Priority Data

May 25, 2007 (JP) ..... 2007-138728

(51) Int. Cl.
*B65H 1/00* (2006.01)

(52) U.S. Cl. ..... 271/171

(58) Field of Classification Search ..... 271/171, 271/9.09, 145; 399/392, 393; 74/109, 29, 74/30

See application file for complete search history.

(56) References Cited

U.S. PATENT DOCUMENTS 5,611,528 A * 3/1997 Nakamura et al. ..... 271/164

(Continued)

FOREIGN PATENT DOCUMENTS

JP 04350024 A * 12/1992

(Continued)

OTHER PUBLICATIONS

Japan Patent Office, Notice of Reasons for Rejection in Japanese Patent Application No. 2007-138728 (counterpart to the above-captioned U.S. Patent Application) mailed Feb. 24, 2009).

(Continued)

*Primary Examiner*—Stefanos Karmis
*Assistant Examiner*—Jeremy Severson
(74) *Attorney, Agent, or Firm*—Baker Botts L.L.P.

(57) ABSTRACT

A guide device includes a pair of side guides configured to guide a sheet in a first direction, and a sliding mechanism configured to support the side guides and to slide the side guides in a second direction perpendicular to the first direction between a first position and a second position. The guide device also includes a pinion rotatably positioned at the tray between the side guides, and a plurality of rack members, in which each of the rack members is connected to and extends from a corresponding one of the side guides in the second direction, and includes a rack which engages the pinion. In addition, each of the rack members is configured to move in the second direction in response to a sliding of the side guides. The guide device further includes a plurality of slide guides positioned at the tray, in which each of the slide guides is configured to guide the rack members when the rack member move in the second direction. The guide device also includes an urging member positioned between at least one of the rack members and a one of the slide guides facing the at least one of the rack members, in which the urging member is configured to urge the at least one of the rack members in the first direction when the side guides are at a predetermined position which is closer to the pinion than the first position which corresponds to a position at which the side guides are a maximum distance from the pinion.

11 Claims, 18 Drawing Sheets

U.S. PATENT DOCUMENTS

| | | | | |
|---|---|---|---|---|
| 6,901,820 | B2 * | 6/2005 | Imahara | 73/865.8 |
| 7,464,927 | B2 * | 12/2008 | Ito et al. | 271/171 |
| 7,637,496 | B2 * | 12/2009 | Sakanashi | 271/171 |
| 2004/0188924 | A1 * | 9/2004 | Ito | 271/171 |
| 2006/0082044 | A1 * | 4/2006 | Aida | 271/145 |
| 2007/0194517 | A1 * | 8/2007 | Nose et al. | 271/171 |
| 2009/0295072 | A1 * | 12/2009 | Blair et al. | 271/171 |

FOREIGN PATENT DOCUMENTS

| | | | | |
|---|---|---|---|---|
| JP | 06234432 | A | * | 8/1994 |
| JP | H07-101561 | A | | 4/1995 |
| JP | H09-136725 | A | | 5/1997 |
| JP | H09-156781 | A | | 6/1997 |
| JP | H11-130273 | A | | 5/1999 |
| JP | 20000025963 | A | | 1/2000 |
| JP | 2000-191147 | A | | 7/2000 |
| JP | 2001-063830 | A | | 3/2001 |
| JP | 2004-244142 | A | | 9/2004 |

OTHER PUBLICATIONS

Japan Patent Office, Notice of Reasons for Rejection for counterpart Patent Application No. JP 2007-138728, mailed Jun. 16, 2009.

* cited by examiner

GUIDE DEVICES AND IMAGE PROCESSING APPARATUS

CROSS REFERENCE TO RELATED APPLICATION

The present application claims priority from Japanese Patent Application No. 2007-138728, which was filed on May 25, 2007, the disclosure of which is incorporated herein by reference in its entirety.

BACKGROUND OF THE INVENTION

1. Field of the Invention

The present invention relates generally to a guide device configured to guide, in a predetermined direction, a sheet positioned on a tray. In particular, the present invention is directed towards a guide device comprising a pair of side guides configured to reliably guide the sheet in the predetermined direction when the sheet is fed.

2. Description of Related Art

Known image processing apparatus, such as copying machines and printers, may include a tray that is configured to receive and to hold a plurality of sheets, such as a plurality of documents or recording sheets. The sheets positioned on the tray are separated one by one and are fed to a position at which the sheet may be scanned, or to a position at which an image may be recorded on the sheet. The tray may include at least one side guide configured to guide the sheets in a sheet feeding direction. The side guide includes an elongated plate having a plane, i.e., a guide surface, extending along the sheet feeding direction. The side guide includes a side registration type and a center registration type. A side guide of the side registration type may be configured to movable in a direction toward and away from a fixed reference plane with which a side edge of a sheet is to contact. The side guide is disposed, such that a guide surface thereof and the fixed reference plane face each other. An opposite side edge of the sheet is to contact the guide surface of the side guide. A pair of side guides of the center registration type are configured to be movable in a direction relative to each other. The side guides are disposed, such that their guide surfaces face each other. Side edges of a sheet are to contact the respective guide surfaces of the side guides. The side guides of both of the types are configured to be slidable in a direction perpendicular to the sheet feeding direction to adjust a distance between the side guide and the fixed reference plane, or a distance between the side guides in accordance with a width of the sheet positioned on the tray. With the side guides of the either of the types, skewing of the sheet during the sheet feeding may be minimized.

A rack-and-pinion interlock mechanism is known to be used to slide the pair of side guides of the center registration type. The known interlock mechanism includes two racks and a pinion. The racks extend from the respective side guides in a direction perpendicular to the sheet feeding direction. The pinion is configured to engage both of the racks. The tray includes a groove in which the racks are movable. The groove is defined by walls on which the racks are slidable. The tray further includes a fixing portion to fix the pinion rotatably. With this structure, when one of the side guides slides, the pinion rotates in response to a linear motion of the rack for the sliding side guide, such that the rotational force of the pinion is transferred to the other rack. Consequently, the other side guide slides in synchronization with the sliding of the one side rack.

In the known side guides, a clearance may be positioned between a slide support portion, e.g., the groove or the wall and the rack, or between each of the racks and the pinion in order to ensure the operability of the side guides. Therefore, the sliding motion of the side guides becomes smoother, such that the side guides readily may slide.

Nevertheless, the clearance between the slide support portion and the rack, or the clearance between each of the racks and the pinion, may be a factor in rattling the side guides. If the side guides rattle, the side guides may be tilted with respect to the sheet feeding direction. If the side guides are tilted, a sheet positioned between the side guides is conveyed and skewed with respect to the sheet feeding direction. When a relatively larger standard-size sheet, for example, an A4-size sheet, a B5-size sheet, or a sheet larger than those size sheets, is fed, a distance between each of the side guides and the pinion increases. At that time, a distance between a first contact portion, which may be positioned at one end of the rack and is to contact the wall of the groove, and a second contact portion, which may be positioned at the other end of the rack and is in contact with the pinion, decreases. When a relatively smaller standard-size sheet, for example, a postcard or a standard photo sheet, is fed, the distance between each of the side guides and the pinion decreases. At that time, the distance between the first contact portion and the second contact portion increases. In any of these cases, a distance between the wall of the groove and a portion of the rack opposite to the first contact portion thereof is substantially the same. Nevertheless, the degree of ratting of the side guides may vary in accordance with the size of a sheet to be fed. That is, the variation in the degree of ratting of the side guides occurs because the distance between the first contact portion and the second contact portion varies in accordance with the size of a sheet to be fed. The rattling of the side guides may be reduced when a relatively larger sheet is fed. The ratting of the side guides may be increased when a relatively smaller sheet is fed, such that the skewing of the sheet is more likely to occur. The skewing of the sheet is undesirable because it may cause fluctuations in a read image, or may cause displacement of an image to be recoded on the recording sheet.

If the clearance between the slide support portion and the rack, or the clearance between each of the racks and the pinion, is decreases, the rattling of the side guides may decrease, such that the degree of the skewing of the sheet may be reduced. Nevertheless, the operability of the side guides also may decrease due to the increased sliding resistance of the slide support portion, or due the increased resistance caused by the engagement of the racks and the pinion.

SUMMARY OF THE INVENTION

Therefore, a need may have arisen for guide devices and image processing apparatus which overcome these and other shortcomings of the related art. A technical advantage of the present invention is that the degree of skewing of a sheet caused by rattling of side guides may be reduced without significantly decreasing operability of the side guides.

According to an embodiment of the present invention, a guide device comprises a pair of side guides positioned at a tray, in which the tray is configured to receive a sheet, and the pair of side guides are configured to guide the sheet in a first direction corresponding to a sheet feeding direction, and a sliding mechanism configured to support the pair of side guides and to slide the pair of side guides between a first position and a second position in a second direction substantially perpendicular to the first direction. The guide device also comprises a pinion rotatably positioned at the tray between the pair of side guides, in which when the plurality of side guides are in the first position a first distance between the plurality of side guides and the pinion is a maximum distance therebetween, and when the plurality of side guides are in the second position a second distance between the plurality of side guides and the pinion is a minimum distance therebetween. Moreover, the guide device comprises a plurality of rack members, in which each of the plurality of rack members is connected to a corresponding one of the pair of side guides, extends from the corresponding one of the pair of side guides toward a middle of the tray in the second direction, and comprises a rack which engages the pinion. In addition, each of the plurality of rack members is configured to move in the second direction in response to a sliding of the plurality of side guides. The guide device further comprises a plurality of slide guides positioned at the tray, in which each of the plurality of slide guides is configured to guide the plurality of rack members when the plurality of rack member move in the second direction. The guide device also comprises an urging member positioned between at least one of the plurality of rack members and a one of the plurality of slide guides facing the at least one of the plurality of rack members, in which the urging member is configured to urge the at least one of the plurality of rack members in the first direction when the plurality of side guides are at a predetermined position, e.g., the second position, which is closer to the pinion than the first position.

According to another embodiment of the present invention, an in image processing apparatus comprises a tray configured to receive a sheet, and a sheet feeding mechanism configured to feed the sheet in a first direction to the tray, in which the first direction corresponds to a sheet feeding direction. The image processing device also comprises a guide device positioned at the tray. The guide device comprises a pair of side guides positioned at the tray, in which the pair of side guides are configured to guide the sheet in the first direction, and a sliding mechanism configured to support the pair of side guides and to slide the pair of side guides between a first position and a second position in a second direction substantially perpendicular to the first direction. The guide device also comprises a pinion rotatably positioned at the tray between the pair of side guides, in which when the plurality of side guides are in the first position a first distance between the plurality of side guides and the pinion is a maximum distance therebetween, and when the plurality of side guides are in the second position a second distance between the plurality of side guides and the pinion is a minimum distance therebetween. Moreover, the guide device comprises a plurality of rack members, in which each of the plurality of rack members is connected to a corresponding one of the pair of side guides, extends from the corresponding one of the pair of side guides toward a middle of the tray in the second direction, and comprises a rack which engages the pinion. In addition, each of the plurality of rack members is configured to move in the second direction in response to a sliding of the plurality of side guides. The guide device further comprises a plurality of slide guides positioned at the tray, in which each of the plurality of slide guides is configured to guide the plurality of rack members when the plurality of rack member move in the second direction. The guide device also comprises an urging member positioned between at least one of the plurality of rack members and a one of the plurality of slide guides facing the at least one of the plurality of rack members, in which the urging member is configured to urge the at least one of the plurality of rack members in the first direction when the plurality of side guides are at a predetermined position, e.g., the second position, which is closer to the pinion than the first position.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-18(C), like numerals being used for like corresponding portions in the various drawings.

Figure 1:
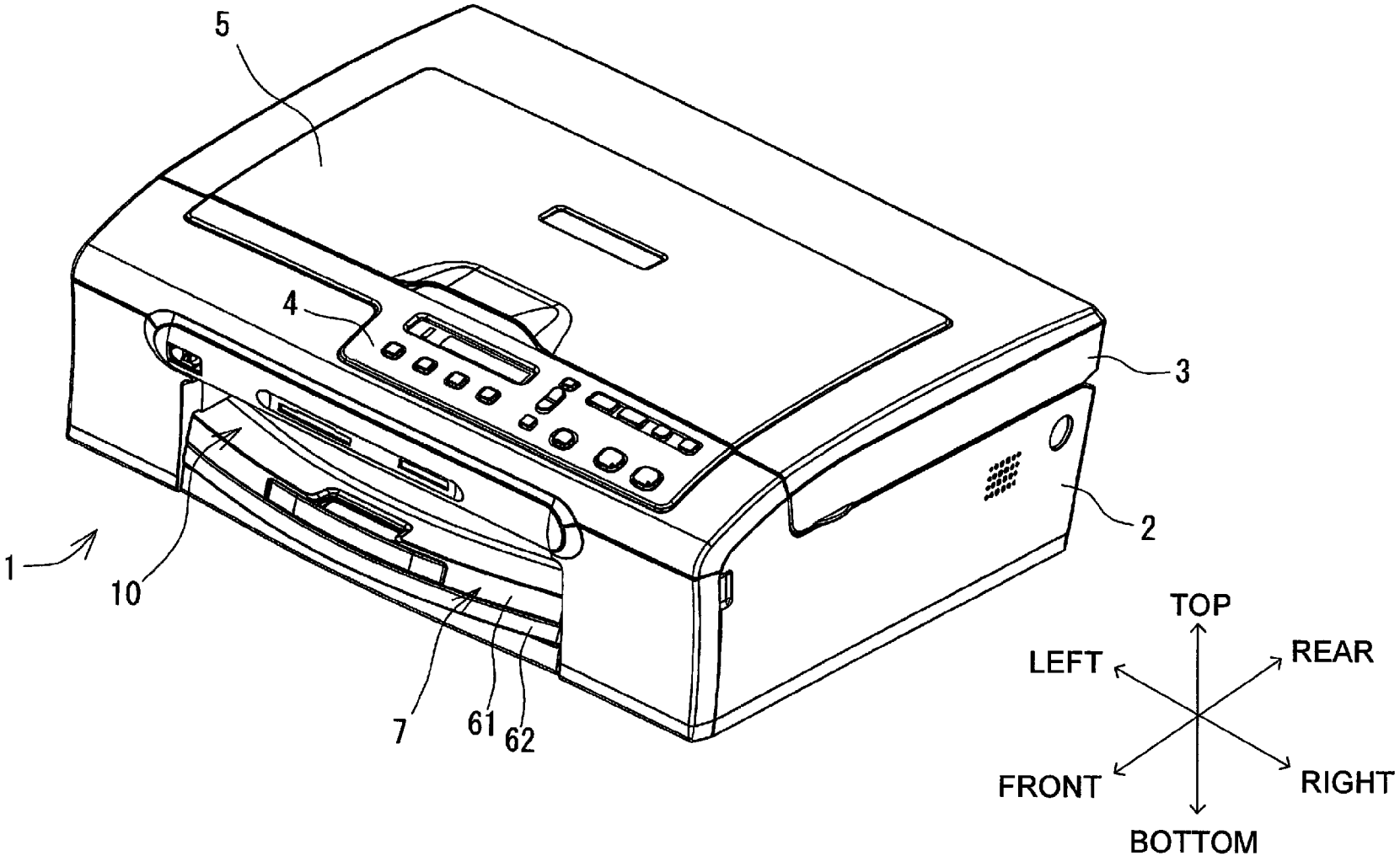
FIG. 1 is a perspective view of a multifunction device, according to an embodiment of the present invention.

Referring to FIG. 1, an image processing apparatus, such as a multifunction device 1, may comprise a printer unit 2, and a scanner unit 3 which may be integral with the printer unit 2. The multifunction device 1 may be configured to perform various functions, such as a printing function, a scanning function, a copying function, or a facsimile function, or any combination thereof.

The multifunction device 1 may have a substantially rectangular, parallelepiped shape having a width, a depth, and a height. Each of the width and the depth may be greater than the height. The scanner unit 3 may be positioned at an upper portion of the multifunction device 1, and may comprise a flatbed scanner. A document cover 5 may be a top panel of the multifunction device 1, and is configured to be selectively opened and closed with respect to a top of the multifunction device 1. The scanner unit 3 may comprise a platen glass (not shown) and an image sensor (not shown) within its main body positioned below the document cover 5. A document may be positioned on the platen glass, and an image may be read from the document by the image sensor.

Figure 2:
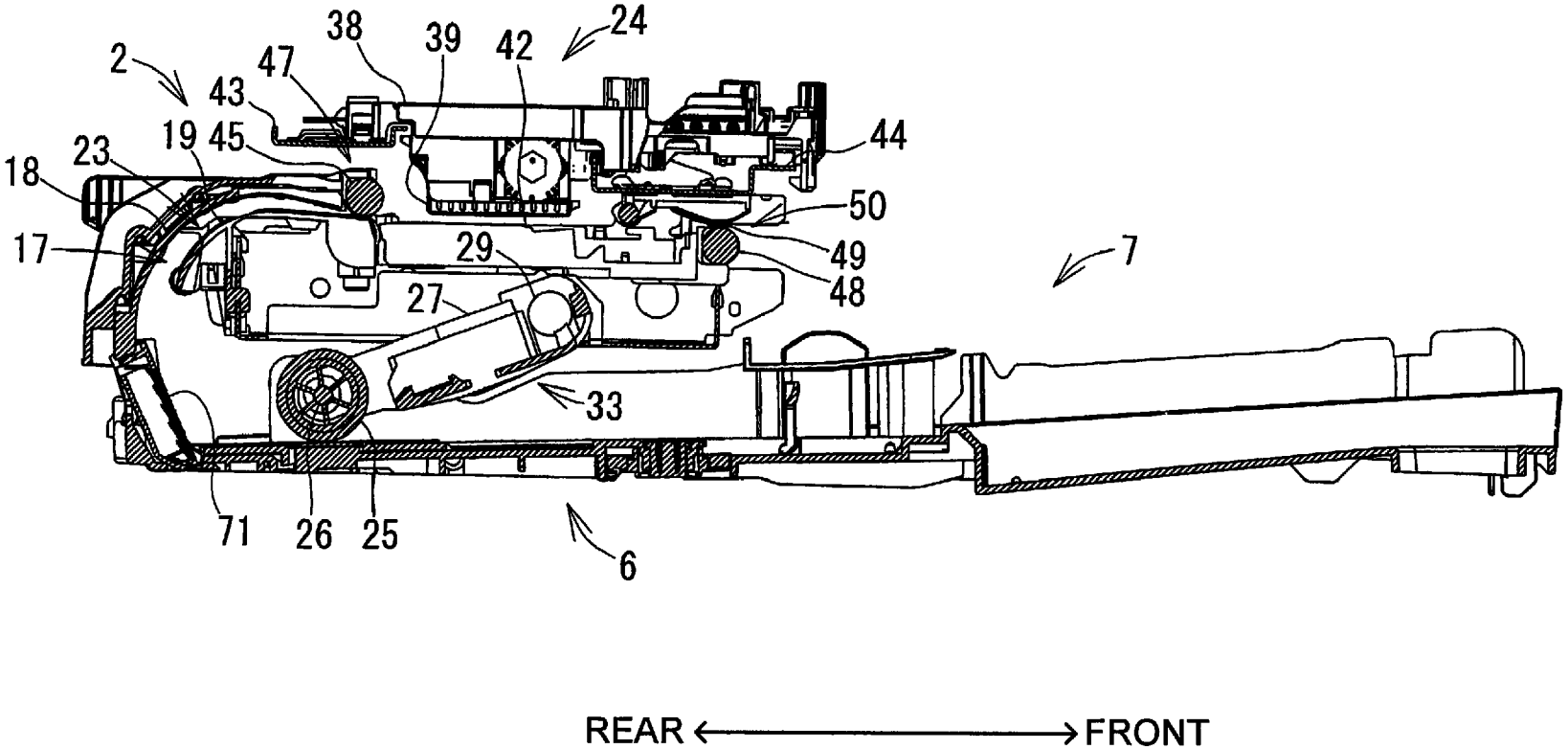
FIG. 2 is a cross-sectional view of a printer unit of the multifunction device of FIG. 1.

The printer unit 2 may be positioned at a lower portion of the multifunction device 1. The printer unit 2 is configured to record an image, e.g., a picture or a text, on a recording sheet based on image data read by the scanner unit 3 or externally inputted image data. The printer unit 2 may comprise a sheet cassette 7 to accommodate one or a plurality of recording sheets therein. Referring to FIGS. 1 and 2, the recording sheet accommodated in the sheet cassette 7 is fed to the printer unit 2 by a sheet feeder 6. The printer unit 2 may comprise an image recording unit 24 configured to record an image on a recording sheet. A desired image may be recorded by the image recording unit 24 onto the recording sheet fed from the sheet cassette 7. The printer unit 2 and the scanner unit 3 may be configured to be activated by a command signal inputted through an operating panel 4 positioned at a top front of the multifunction device 1, or a command signal transmitted from an external device by a printer driver or a scanner driver.

Referring to FIGS. 1-3B, the printer unit 2 may comprise the sheet feeder 6. The sheet feeder 6 may comprise the sheet cassette 7 and a sheet feeding mechanism 33. The printer unit 2 may have an opening 10 formed therethrough at a front of the printer unit 2. The sheet cassette 7 may be configured to be selectively attached to and detached from an interior of the printer unit 2 through the opening 10. The sheet cassette 7 may receive a stack of recording sheets.

The sheet feeding mechanism 33 may comprise a sheet supply roller 25, a drive transmission mechanism, and a swing arm 27. The swing arm 27 supports the sheet supply roller 25 and the drive transmission mechanism. The drive transmission mechanism is not shown in the drawings because the drive transmission mechanism may be positioned inside the swing arm 27. A drive shaft 29 may be positioned above the sheet cassette 7 and may extend along the width direction of the multifunction device 1, i.e., a direction perpendicular to the drawing sheet of FIG. 2. The drive shaft 29 is supported by a body frame of the multifunction device 1 and may be configured to rotate. A motor (not shown) may be connected to an end of the drive shaft 29. As the motor is driven, a drive force, e.g., a rotational torque, acting in a predetermined direction is transmitted to the drive shaft 29.

The swing arm 27 is supported by the drive shaft 29 and is configured to swing about the drive shaft 29. The swing arm 27 may be at substantially a middle position in the width direction of the multifunction device 1, and may extend toward the rear of the multifunction device 1, i.e., toward the left in FIG. 2, from the drive shaft 29. The sheet supply roller 25 may be rotatably supported at a free end of the swing arm 27. More specifically, a rotational shaft 26 may be supported at the free end of the swing arm 27, and the sheet supply roller 25 may be fixed to the rotational shaft 26. With this structure, the sheet supply roller 25 may be configured to be selectively in contact with and separated from a topmost recording sheet in the sheet cassette 7. In FIG. 2, a roller surface of the sheet supply roller 25 is in contact with a sheet placing surface of the sheet cassette 7.

The drive force inputted into the drive shaft 29 is further transmitted to the sheet supply roller 25 via the drive transmission mechanism. When the drive force is transmitted to the sheet supply roller 25 with the sheet supply roller 25 contacting a topmost recording sheet in the stack, the topmost recording sheet is picked up from the stack by the sheet supply roller 25 and is fed into a sheet conveying path 23.

The printer unit 2 may have the sheet conveying path 23 through which a recording sheet is conveyed. The sheet conveying path 23 extends toward the sheet supply roller 25 from a downstream end of the sheet cassette 7 in a sheet feeding direction to the top of the multifunction device 1. The sheet feeding direction is a direction in which the sheet cassette 7 feeds a recording sheet. More specifically, the sheet conveying path 23 may comprise a curved portion 17. The sheet conveying path 23 extends from the downstream end of the sheet cassette 7 toward the rear of the multifunction device 1, and further extends along the rear of the multifunction device 1 toward the top of the multifunction device 1 through the curved portion 17. The sheet conveying path 23 then further extends toward the front of the multifunction device 1, i.e., toward the right in FIG. 2, and reaches the opening 10 via the image recording unit 24. Thus, the recording sheet fed into the sheet conveying path 23 from the sheet cassette 7 by the sheet supply roller 25 is guided to the image recording unit 24 while the recording sheet is U-turned at the curved portion 17, such that the sheet conveying position of the recording sheet is changed from the lower portion to the upper portion of the multifunction device 1. After an image is recorded on the recording sheet by the image recording unit 24, the recording sheet is discharged to the opening 10.

The sheet conveying path 23 may comprise an outer guide surface and an inner guide surface, which face each other at a predetermined distance from each other. The outer and inner guide surfaces may correspond to the sheet conveying path 23 other than a portion where the image recording unit 24 is positioned. For example, the curved portion 17 of the sheet conveying path 23 may comprise an outer guide member 18 and an inner guide member 19, which are fixed to the body frame of the multifunction device 1.

A platen 42 may be positioned downstream in the sheet conveying direction from a downstream end of the curved portion 17 in a sheet conveying path 23. The sheet conveying direction refers to a direction in which a recording sheet is conveyed in the printer unit 2. The image recording unit 24 may be positioned above the platen 42. The image recording unit 24 may comprise a carriage 38. The carriage 38 may be mounted with an inkjet recording head 39. Guide rails 43 and 44 may extend in a main scanning direction, i.e., a direction perpendicular to the drawing sheet of FIG. 2, perpendicular to the sheet conveying direction. The carriage 38 may be supported by the guide rails 43 and 44 and may reciprocate in the main scanning direction. When the carriage 38 reciprocates in the main scanning direction, each color of ink may be selectively ejected from the inkjet recording head 39 to recorded an image onto the recording sheet that moves along the platen 42 in the sheet conveying direction.

Figure 3A:
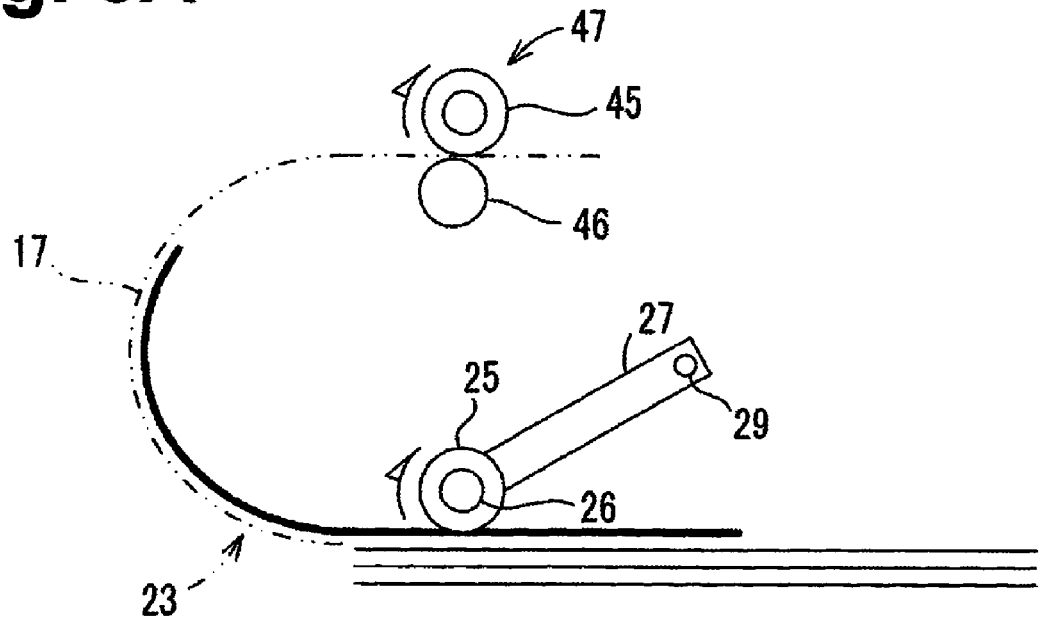
FIGS. 3A and 3B are schematic, sectional views of a sheet feeder of the multifunction device of FIG. 1.
Figure 3B:
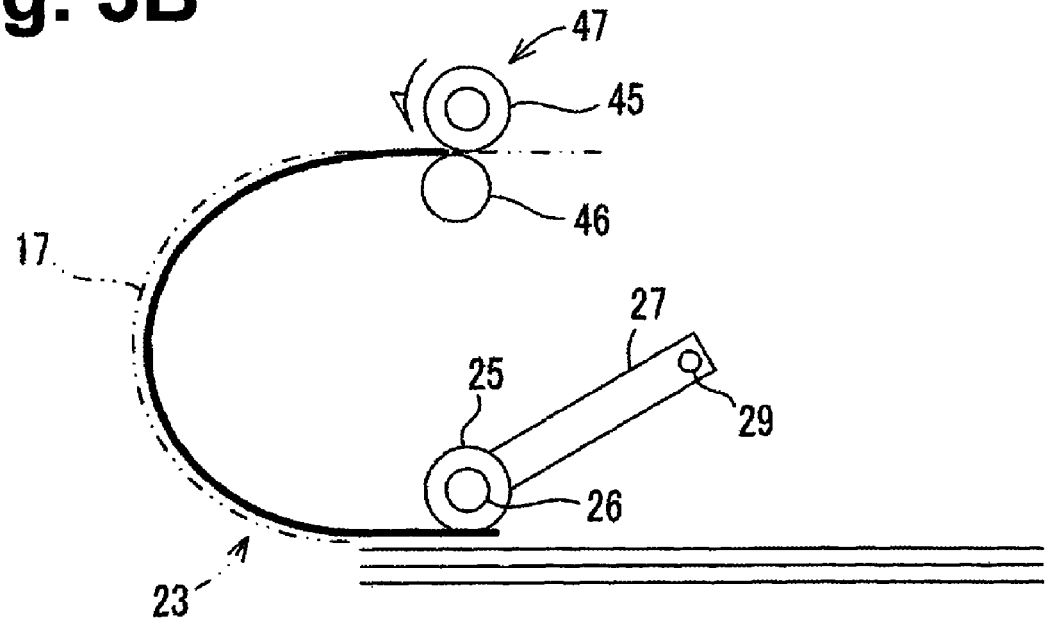

A pair of conveyor rollers 47 comprising a drive roller 45 and a pinch roller 46 may be positioned upstream from the image recording unit 24 in the sheet conveying direction. In FIG. 2, the pinch roller 46 is omitted from the drawing. Referring to FIGS. 3A and 3B, the pinch roller 46 may be positioned under the drive roller 45 and may contact the drive roller 45 while being pressed thereto. A pair of discharge rollers 50 comprising a drive roller 48 and a spur roller 49 may be positioned downstream from the image recording unit 24 in the sheet conveying direction. The pair of discharge rollers 50 may be configured to pinch therebetween the recording sheet having an image thereon, and to convey the recording sheet toward the opening 10. The drive roller 45 and the drive roller 48 are driven by a motor (not shown).

A recording sheet may be fed and conveyed in the printer unit 2. For example, Referring to FIG. 3A, the sheet supply roller 25 may be rotated in the sheet conveying direction, i.e., in a clockwise direction in FIG. 3A, by the motor. Then, a topmost recording sheet in the stack accommodated in the sheet cassette 7 is fed into the sheet conveying path 23 by the sheet supply roller 25. At that time, the drive roller 45 is rotated in a direction opposite to the sheet conveying direction. The recording sheet, which has reached the pair of conveyor rollers 27 through the sheet conveying path 23, is temporarily stopped while a leading edge of the recording sheet in the sheet conveying direction is pressed against a nip portion of the pair of conveyor rollers 47 because the drive roller 45 rotates in the direction opposite to the sheet conveying direction. When the recording sheet is pressed against the nip portion of the pair of conveyor rollers 47, the leading edge of the recording sheet is aligned, and skewing of the recording sheet is corrected. The alignment of the recording sheet by the pair of conveyor rollers 47 corresponds to a registration operation.

After the registration operation, the drive roller 45 is rotated in the sheet conveying direction, i.e., in a counterclockwise direction in FIG. 3B, by the motor, such that the recording sheet is further conveyed by the pair of conveyor rollers 47 while being pinched therebetween. At that time, the sheet supply roller 25 stops rotating while pinching a trailing edge of the recording sheet. A one-way clutch (not shown) may be coupled to the sheet supply roller 25, such that the trailing edge of the recording sheet readily may disengage therefrom by a conveying force of the drive roller 45.

Then, the recording sheet is conveyed by a predetermined amount by the pair of conveyor rollers 47, and the leading edge of the recording sheet is moved to a predetermined position on the platen 42. After the leading edge positioning operation, an image is recorded onto the recording sheet. During the image recording operation, the drive roller 45 is intermittently rotated in the sheet conveying direction, such that the recording sheet is intermittently conveyed. While the conveyance of the recording sheet is temporarily stopped, the ink is ejected onto the recording sheet from the inkjet recording head 39, and an image is recoded on the recording sheet. The recording sheet having the desired image formed therein then is then further conveyed toward the opening 10 by the pair of discharge rollers 50.

After the image recording operation is completed with respect to the recording sheet, a series of operations, e.g., the sheet supplying operation, the sheet conveying operation, and the sheet output operation, may be successively performed on a subsequent recording sheet if the image recording operation is to be performed on one or more of the subsequent recording sheets.

Referring to FIGS. 4-11, an arrow 55 indicates a direction that a recording sheet may be fed from a sheet cassette 7 in the sheet conveying direction. The sheet cassette 7 may comprise a main tray 61 and a secondary tray 62. The main tray 61 and the secondary tray 62 may be positioned in the opening 10, such that the secondary tray 62 is stacked above the main tray 61.

The main tray 61 may have a substantially rectangular plate shape, and may be elongated in the sheet feeding direction indicated by the arrow 55. The main tray 61 is configured to accommodate therein a stack of recording sheets having various sizes, e.g., A4 and B5 specified in JIS, postcards, and standard photos (approximately 89 mm×127 mm).

The main tray 61 may comprise a bottom plate 64 on which a recording sheet is positioned. The main tray 61 further may comprise an inclined plate 67 at its front end 65, i.e., a downstream end in the sheet feeding direction. The inclined plate 67 may comprise a plate member elongated in a width direction of the main tray 61, i.e., in a direction perpendicular to the sheet feeding direction, and may have an inner surface 69. The inclined plate 67 may be tilted toward the rear of the multifunction device 1. Thus, when the recording sheet positioned on the main tray 61 is fed by the sheet supply roller 25, a leading edge of the recording sheet is guided diagonally upward along the inner surface 69 of the inclined plate 67. The inner surface 69 serves as a guide surface that guides the recording sheet to the sheet conveying path 23.

A separating member 71 may be positioned on the inner surface 69. The separating member 71 may be positioned at substantially a middle of the inclined plate 67 in a longitudinal direction of the inclined plate 67. The inclined plate 67 may have a plurality of teeth that protrude from the inner surface 69 and are arranged in an inclined direction of the inclined plate 67. When recording sheets in a stack are fed and their leading edges contact the inner surface 69, the leading edges of the recording sheets are separated from each other by the separating member 71, and the teeth of the separating member 71 enter between the recording sheets, such that a clearance may be formed between the recording sheets. Thus, the recording sheets readily may be separated from each other. Consequently, combined with a force applied to the recording sheets by the sheet supply roller 25 during the sheet feeding operation, a topmost recording sheet surely is separated from the rest of recording sheets in the stack.

A plurality of rollers 73, e.g., a pair of rollers, are rotatably positioned in the inner surface 69, such that their roller surfaces are exposed from the inner surface 69. The rollers 73 are not shown in FIGS. 8 and 9. The rollers 73 may be positioned on opposite sides of the separating member 71 to be separated from each other in the longitudinal direction of the inclined plate 67. The rollers 73 allow a friction, which is applied on the recording sheet by the inner surface 69, to be reduced.

A pair of guide grooves 125 and 126 may be formed in the bottom plate 64 and may extend along the width direction of the bottom plate 64. Each of the guide grooves 125 and 126 may have a rectangular shape extending in the width direction of the bottom plate 64, and may penetrate through the bottom plate 64. The guide grooves 125 and 126 may be positioned in the right and left portions, respectively, of the main tray 61 when viewed from the upstream in the sheet feeding direction. The guide grooves 125 and 126 are displaced from each other in the sheet feeding direction.

Figure 10:
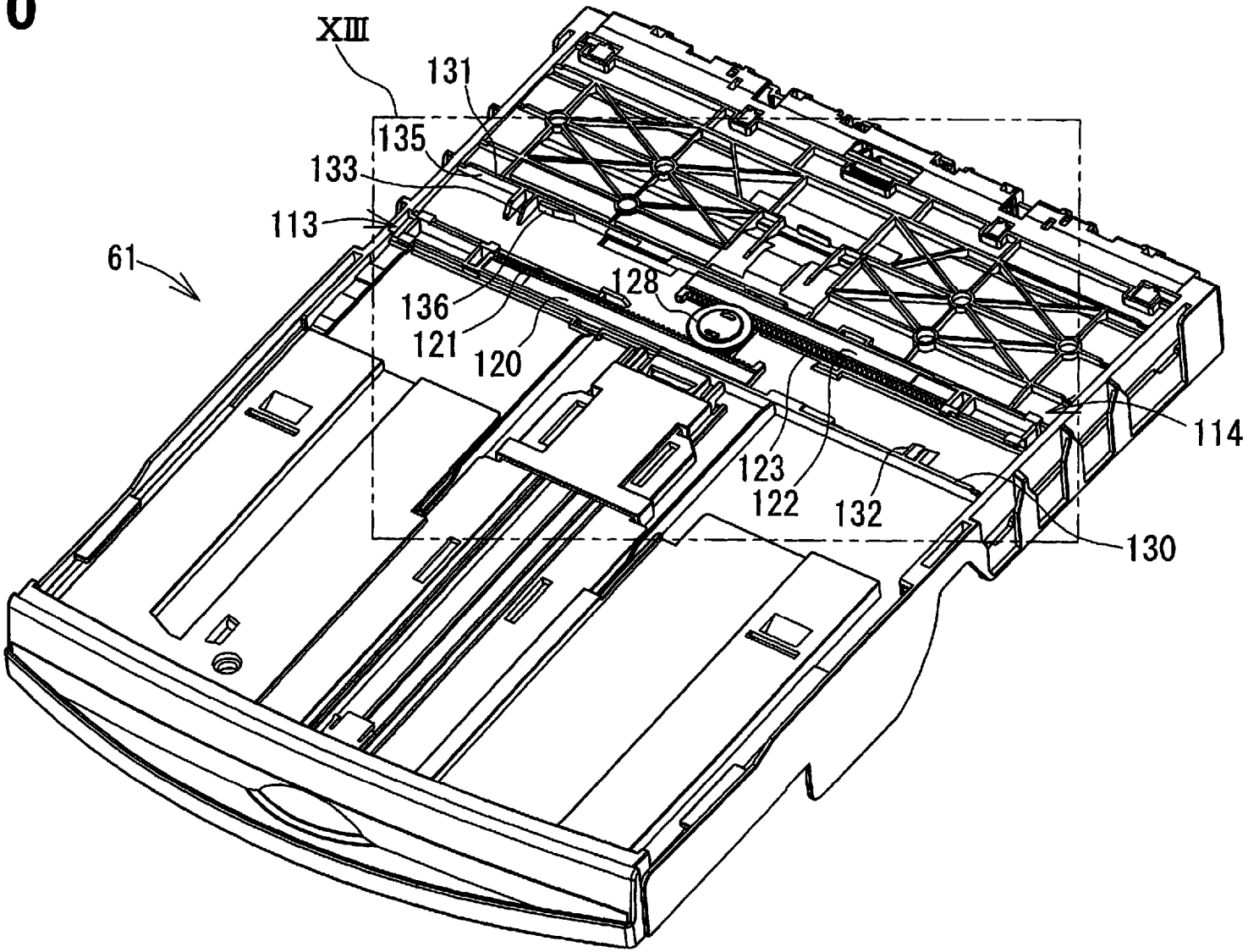
FIG. 10 is a perspective view of an underside of the main tray of FIG. 7, in which the distance between the side guides is at the maximum distance.
Figure 11:
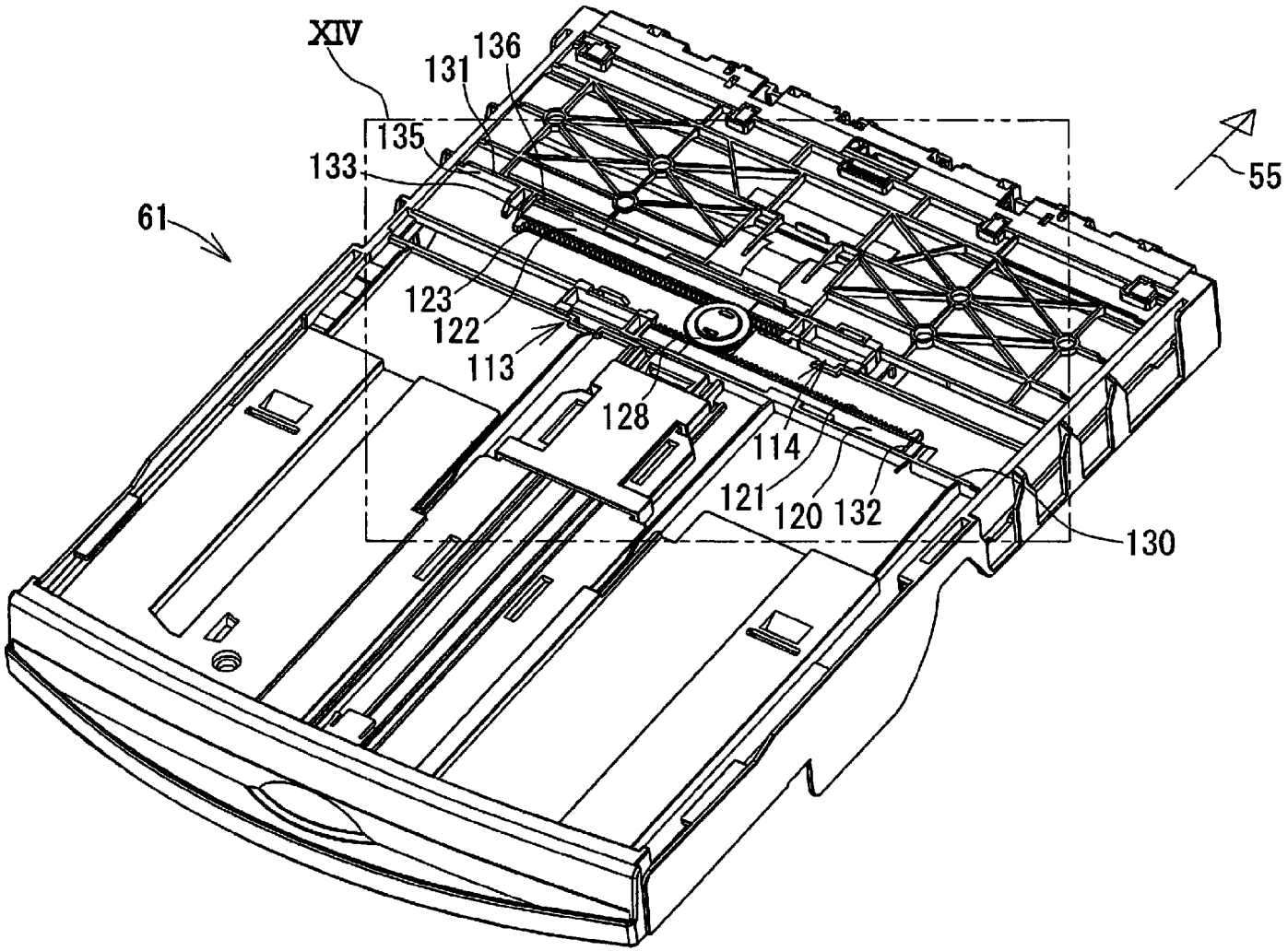
FIG. 11 is a perspective view of the underside of the main tray of FIG. 7, in which the distance between the side guides is at the minimum distance.

Referring to FIGS. 10 and 11, a pinion 128 may be positioned between the guide groove 125 and the guide groove 126 at substantially a middle of an underside of the bottom plate 64 in its width direction. The pinion 128 may be rotatably supported by the underside of the bottom plate 64, and racks 121 and 123 may engage the pinion 128.

Figure 7:
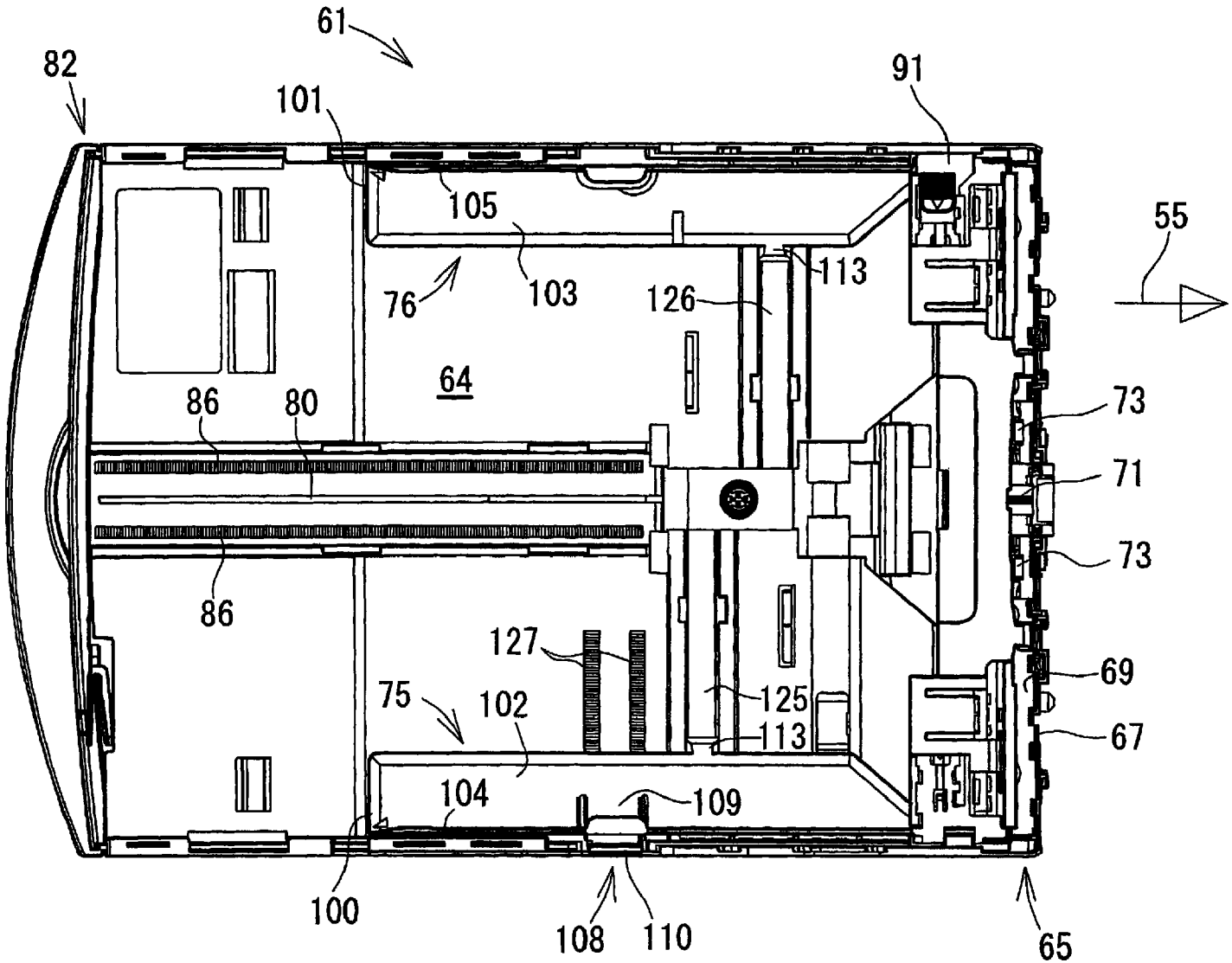
FIG. 7 is a plan view of a main tray of the sheet cassette of FIG. 4.
Figure 8:
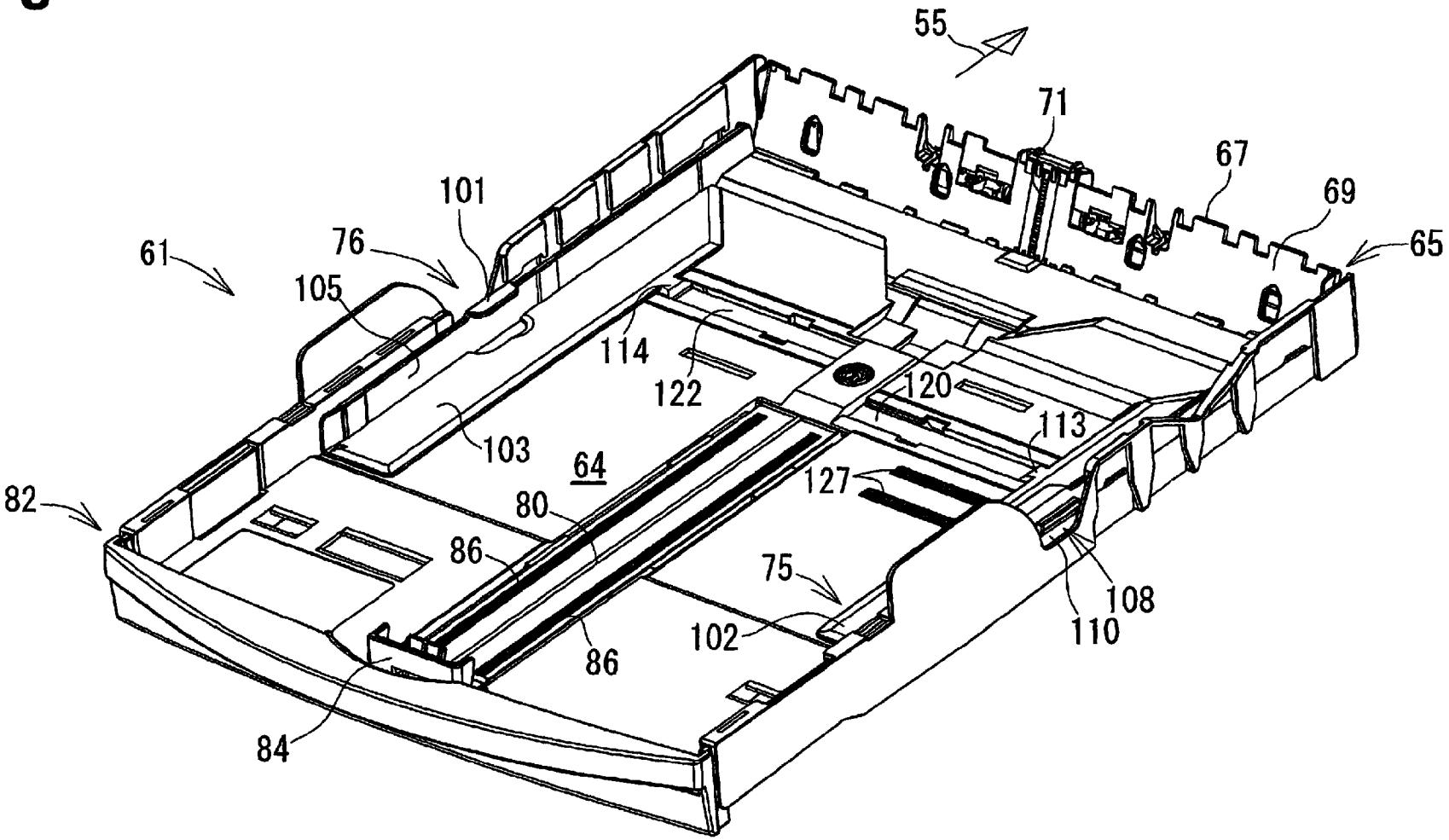
FIG. 8 is a perspective view of a topside of the main tray of FIG. 7, in which a distance between side guides is at a maximum distance.
Figure 9:
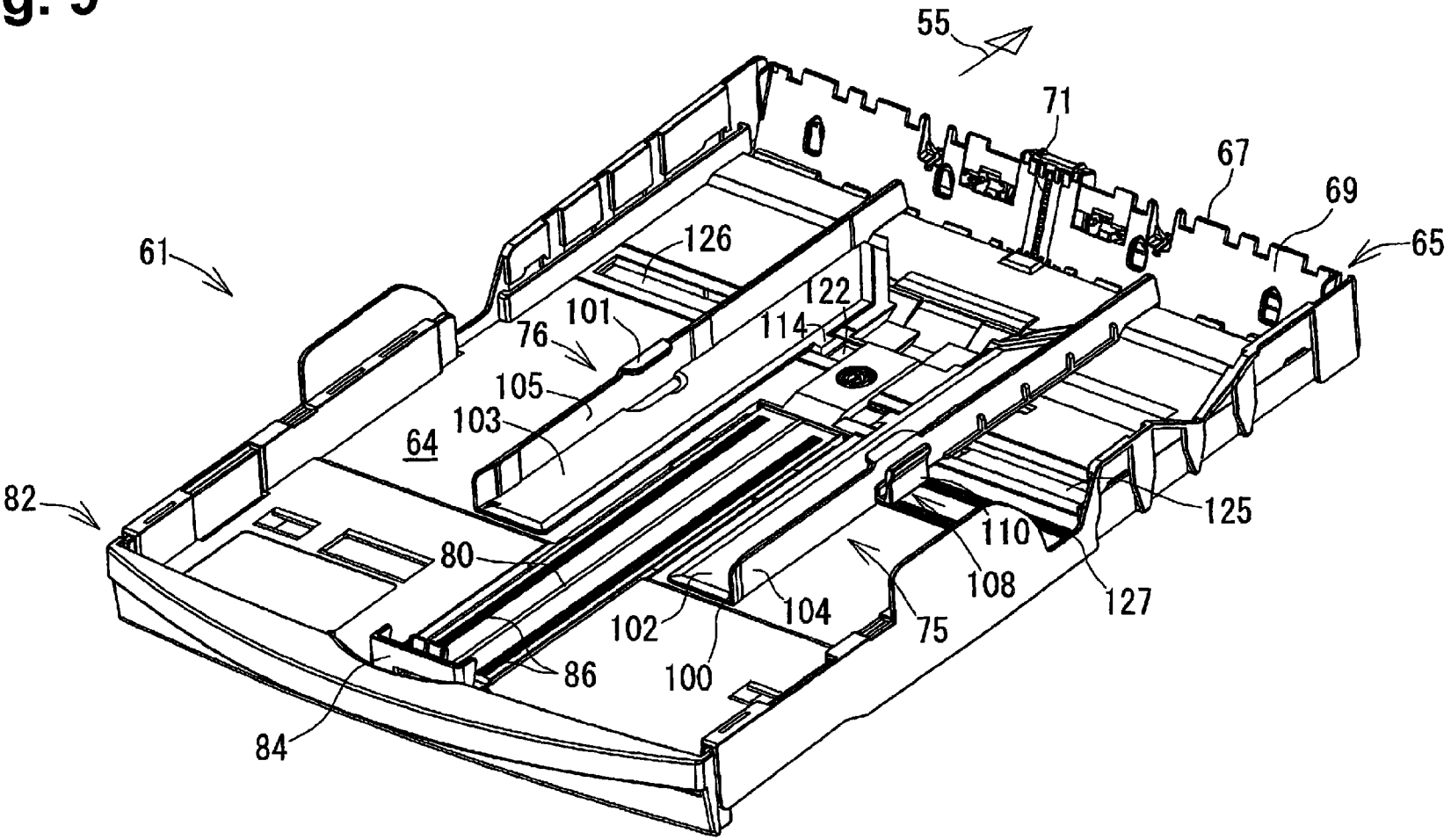
FIG. 9 is a perspective view of the topside of the main tray of FIG. 7, in which the distance between the side guides is at a minimum distance.

Referring to FIGS. 7-9, a pair of side guides 75 and 76 may be positioned on a topside of the bottom plate 64. The side guides 75 and 76 may be supported to be slidable in a direction substantially perpendicular to the sheet feeding direction, i.e., in the width direction of the main tray 61. The side guides 75 and 76 may be supported to be slidable along the guide grooves 125 and 126, respectively. A guide device may comprise the side guides 75 and 76, the pinion 128, the sliding mechanism, rack members 120 and 122, slide guides 130 and 131, and a guide piece 136.

The side guides 75 and 76 may be configured to regulate positions of side edges of a recording sheet positioned on the main tray 61 in the width direction of the recording sheet. More specifically, the side guides 75 and 76 may be configured to regulate the positions of the side edges of the recording sheet positioned on the main tray 61 to align a center of the recording sheet in the sheet width direction with a predetermined reference position, e.g., a center of the main tray 61 in the width direction of the main tray 61. Such an operation corresponds to a center registration. The side guides 75 and 76 further may be configured to guide the recording sheet in the sheet feeding direction, i.e., in the direction indicated by the arrow 55, e.g., a first direction, when the recording sheet is fed from the main tray 61. The side guides 75 and 76 may minimize the occurrence of the skewing of the recording sheet when the recording sheet is fed.

A plurality of slits 127 may be formed in the topside of the bottom plate 64. Each of the slits 127 extends in a direction corresponding to the sheet feeding direction. The slits 127 may be arranged side by side in the width direction of the main tray 61. A plurality of slit groups, e.g., a pair of slit groups, comprising the plurality of slits 127 may be positioned upstream from the guide groove 125 in the sheet feeding direction. The side guide 75 may be fixed to the main tray 61 by which hooks of a lever 108 engage the slits 127.

An elongated groove 80 is formed in the bottom plate 64, and may extend in the sheet feeding direction. The groove 80 may extend from substantially the middle of the main tray 61 in the longitudinal direction of the main tray 71 to a rear end 82, i.e., an upstream end in the sheet feeding direction, of the main tray 61. A rear guide 84 may be slidable along the groove 80. The rear guide 84 is not shown in FIG. 7. The rear guide 84 is configured to regulate a position of a trailing edge of a recording sheet accommodated in the main tray 61. When the rear guide 84 slides in the sheet feeding direction along the groove 80 with a recording sheet accommodated in the main tray 61, the rear guide 84 contacts a trailing edge of the recording sheet, such that the trailing edge of the recording sheet is aligned and regulated at a position in accordance with the sheet size.

A plurality of slits 86 may be formed in the bottom plate 64 on each side of the groove 80, and may be arranged side by side along a longitudinal direction of the groove 80. Each of the slits 86 extends in a direction coinciding with a direction perpendicular to the extending direction of the groove 80. The rear guide 84 may be fixed to the main tray 61 by which a hook (not shown) of the rear guide 84 is inserted into the slits 86.

Figure 4:
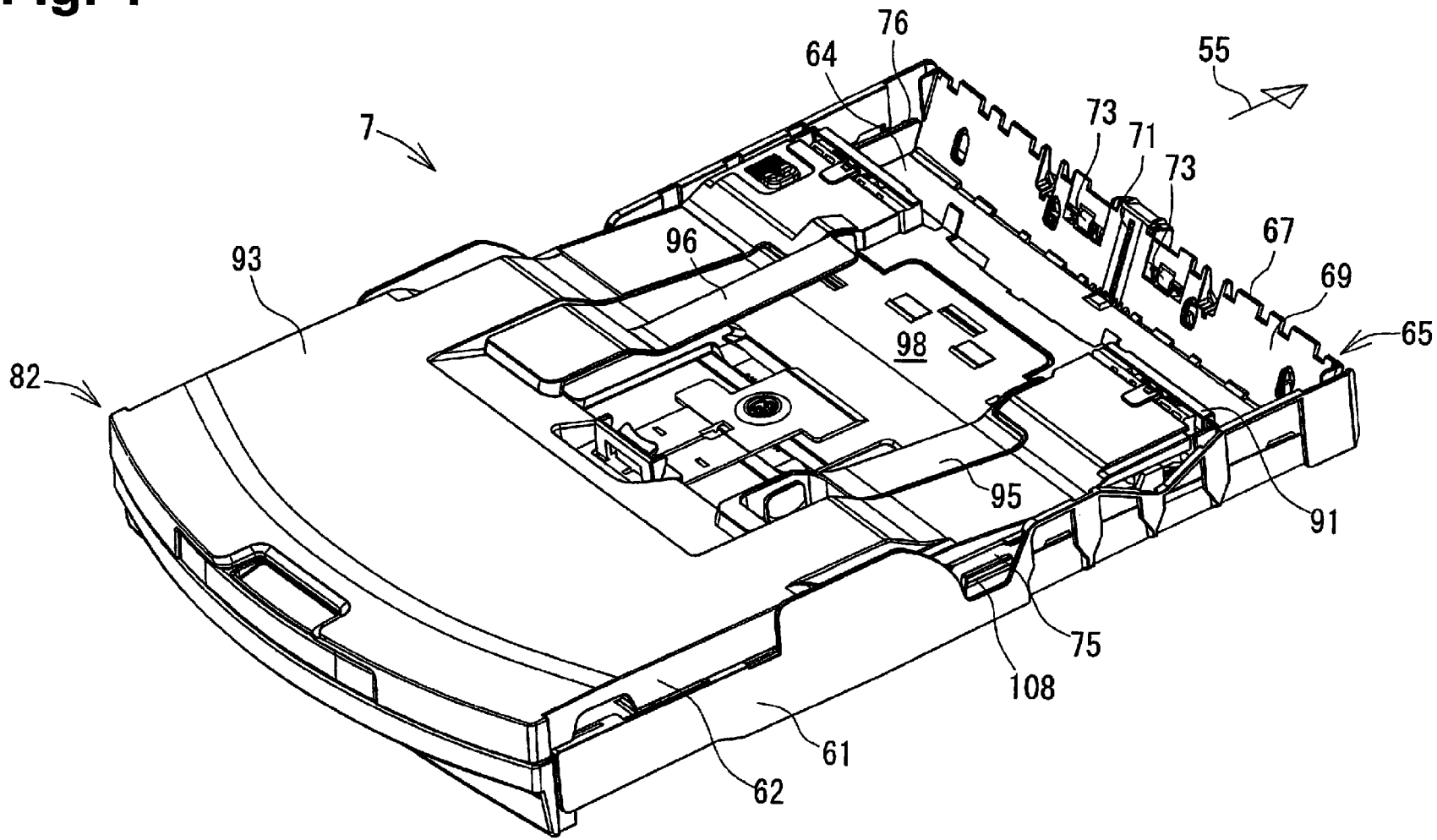
FIG. 4 is a perspective view of a sheet cassette of the multifunction device of FIG. 1.
Figure 5:
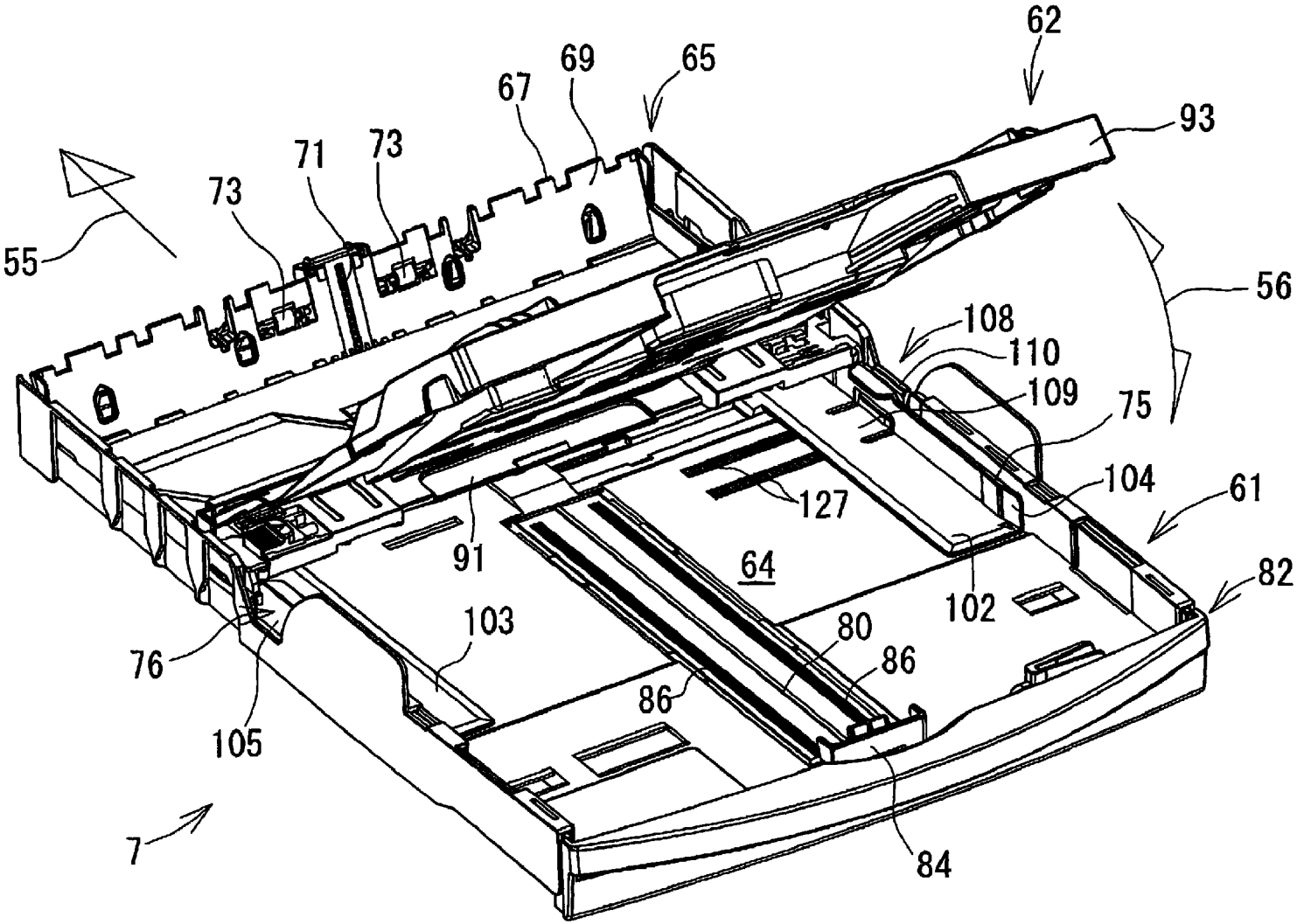
FIG. 5 is another perspective view of the sheet cassette of the multifunction device of FIG. 1.
Figure 6:
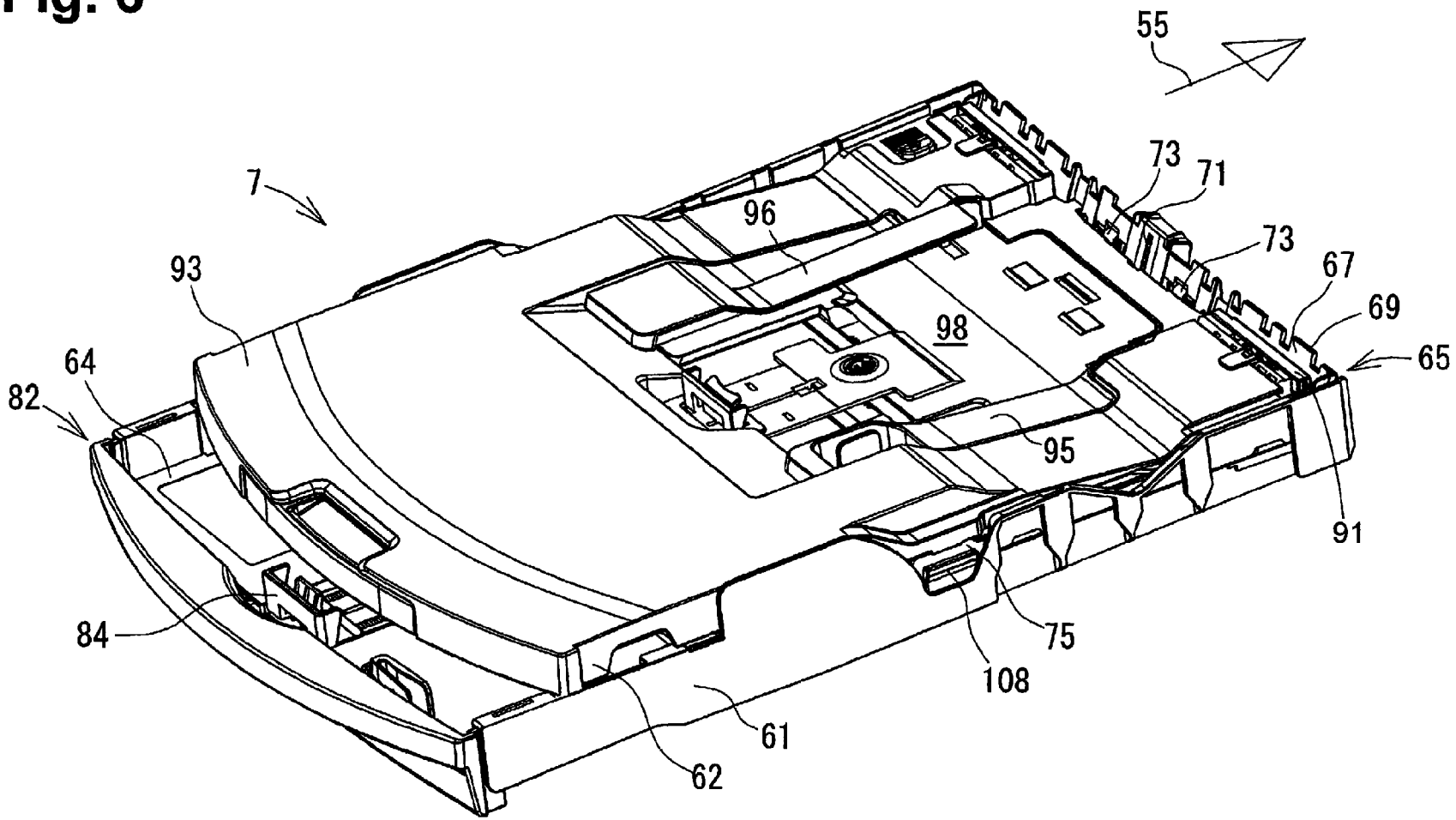
FIG. 6 is yet another perspective view of the sheet cassette of the multifunction device of FIG. 1.

Referring to FIGS. 4-6, the secondary tray 62 may be positioned above the main tray 61. The secondary tray 62 may be configured to accommodate therein a thicker recording sheet having a relatively smaller size. For example, the secondary tray 62 may be configured to accommodate therein postcards, envelops, or calendared standard photo sheets. The secondary tray 62 may be attached to the main tray 61 to be slidable in the sheet feeding direction, i.e., in the direction indicated by the arrow 55.

The secondary tray 62 may have a substantially the same width as the width of the main tray 61. The secondary tray 62 may be slightly shorter in length than the main tray 61 in the sheet feeding direction, and the secondary tray 62 may have a rectangular plate shape. The secondary tray 62 may comprise a pair of side guides 95 and 96. The secondary tray 62 may be configured to accommodate therein a recording sheet within an area defined by the side guides 95 and 96. The side guides 75 and 76 and the side guides 95 and 96 may be substantially similar in structure, except that shape and the sliding range of the side guides 95 and 96 may be different from those of the side guides 75 and 76.

The secondary tray 62 may comprise a slidable portion 91 and a rotatable portion 93. The slidable portion 91 may comprise a plate member having substantially the same width as the width of the main tray 61, and may be attached to the main tray 61 to be slidable in the sheet feeding direction. The slidable portion 91 may be configured to slide between a position at which the slidable portion 91 (the second tray 62) is located at a position adjacent to the inclined plate 67, and a position at which the slidable portion 91 (the second tray 62) is located at a position separated from the inclined plate 67.

The rotatable portion 93 may comprise a plate member having substantially the same width as the width of the main tray 61. The rotatable portion 93 may be configured to rotate in directions indicated by an arrow 56 with respect to the slidable portion 91. The side guides 95 and 96 may be positioned at a bottom plate 98 of the rotatable portion 93, e.g., the bottom plate 98 of the secondary tray 62.

When the sheet cassette 7 is attached to the printer unit 2 and the secondary tray 62 is located at the position where the slidable portion 91 (the second tray 62) is located at a position adjacent to the inclined plate 67, the front end 65 of the main tray 61 contacts the swing arm 27 to allow the swing arm 27 to rotate upward about the drive shaft 29. Thus, the sheet supply roller 25 is lifted and is positioned on the bottom plate 98 of the secondary tray 62. At that time, the sheet supply roller 25 contacts a recording sheet accommodated in the secondary tray 62. Thus, the recording sheet positioned on the secondary tray 62 is allowed to be fed in the sheet feeding direction.

When the sheet cassette 7 is attached to the printer unit 2 and the secondary tray 62 is located at the position at which the slidable portion 91 (the second tray 62) is located at a position separated from the inclined plate 67, the front end 65 of the main tray 61 contacts the swing arm 27 to allow the swing arm 27 to rotate upward about the drive shaft 29. Then, the sheet supply roller 25 enters a clearance between a front end of the secondary tray 62 and the front end 65 of the main tray 61 and is positioned on the topside of the main tray 61. At that time, the sheet supply roller 25 contacts a recording sheet accommodated in the main tray 61. Thus, the recording sheet positioned on the main tray 61 is allowed be fed in the sheet feeding direction.

Figure 12:
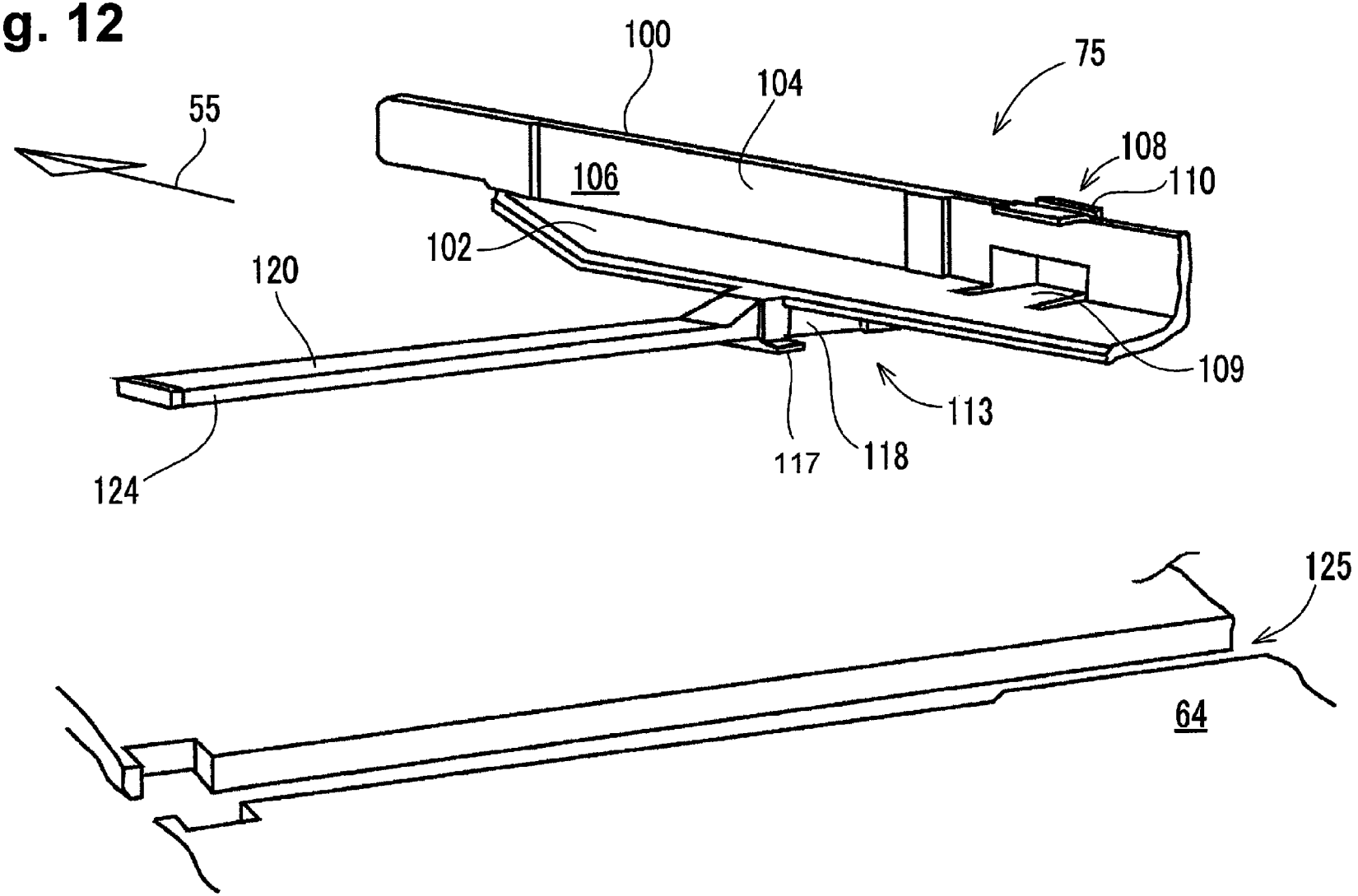
FIG. 12 is a partial, perspective view of one of the side guides and a sliding mechanism for the side guide.
Figure 13:
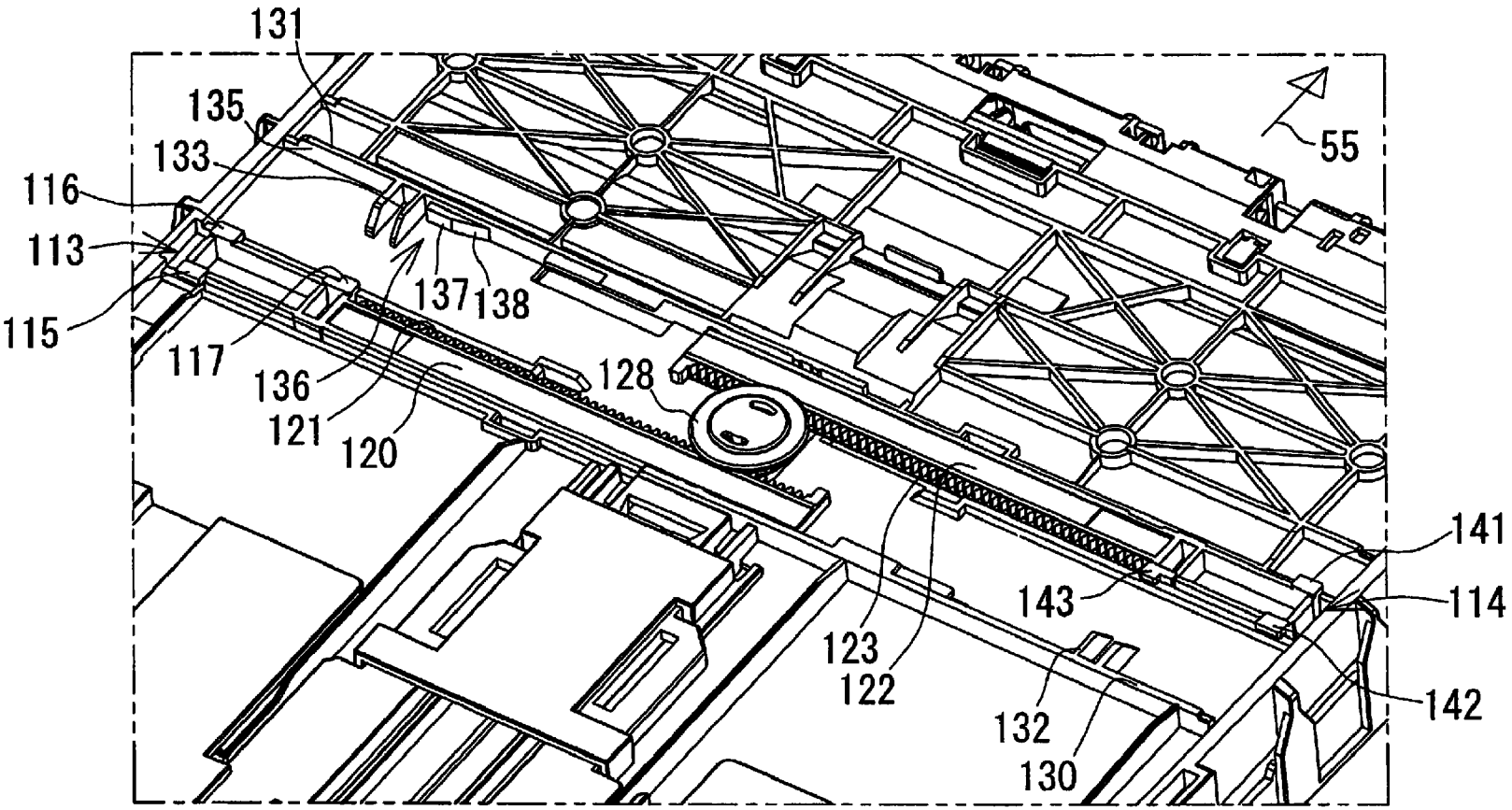
FIG. 13 is an enlarged view of a portion XIII enclosed with a double dot and dashed line in FIG. 10.
Figure 14:
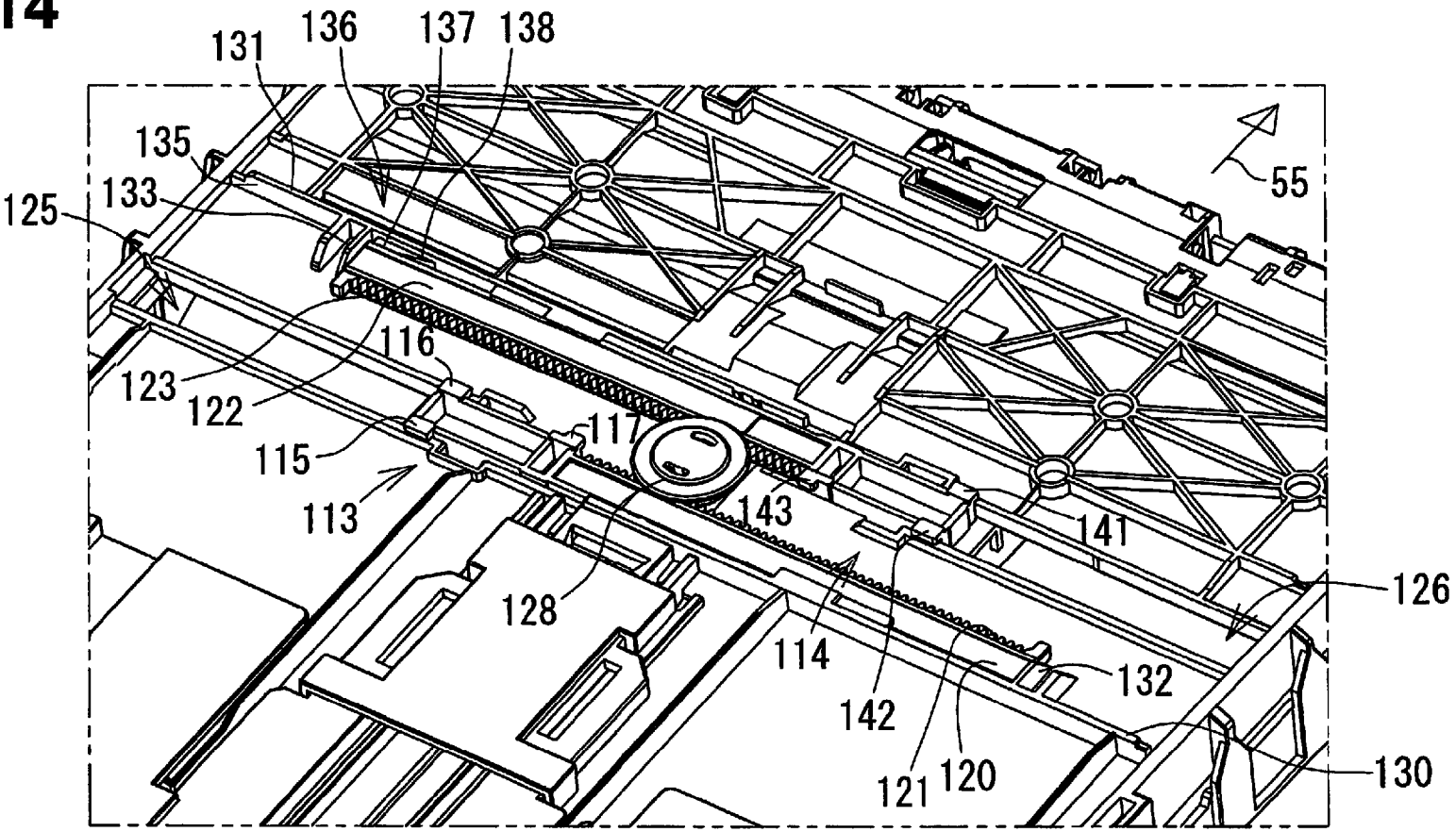
FIG. 14 is an enlarged view of a portion XIV enclosed with a double dot and dashed line in FIG. 11.

Referring to FIGS. 12-14, the side guides 75 and 76 may be positioned at the right and left portions, respectively, of the main tray 61 when viewed from the upstream in the sheet feeding direction. The side guide 75 may comprise a substantially L-shaped member 100 comprising a synthetic resin, e.g., an ABS resin. The L-shaped member 100 may be elongated in the sheet feeding direction indicated by the arrow 55. The L-shaped member 100 may comprise a first wall, e.g., a bottom wall 102, and a second wall 104 having an inner surface 106. The first wall 102 extends parallel to the bottom plate 64 of the main tray 61. The recording sheet may be positioned on the first wall 102. The second wall 104 extends from an outer edge of the first wall 102 in the width direction of the first wall 102 to be perpendicular to the first wall 102. The inner surface 106 of the second wall 104 contacts a side edge of a recording sheet in the sheet width direction.

Referring to FIGS. 9-12, the lever 108 may be positioned at the second wall 104. The lever 108 may be formed integral with the side guide 75, and may comprise the resin corresponding to the resin used for the side guide 75. The lever 108 may comprise a base portion 109 and an extending portion 110. The base portion 109 of the lever 108 may protrudes outwardly, in the width direction of the main tray 61, from a corner formed between the first wall 102 and the second wall 104. The extending portion 110 may extend upwardly from an edge of the base portion 109. The base portion 109 may comprise a pair of hooks (not shown) on a surface facing the bottom plate 64. The side guide 75 may be fixed with respect to the bottom plate 64 by which the hooks of the base portion 109 are inserted into the respective slits 127. The extending portion 110 and the base portion 109 may be elastically deformed by which the extending portion 110 is pressed inward in the width direction of the main tray 61, such that the base portion 109 is lifted from the bottom plate 64. By doing so, the hooks of the base portion 109 are disengaged from the respective slits 127, such that the fixing of the side guide 75 is released.

A slidable portion 113 may be positioned at a surface of the first wall 102 facing the bottom plate 64, and at a position corresponding to the guide groove 125 formed in the bottom plate 64 to be insertable into the guide groove 125. More specifically, the slidable portion 113 may protrude toward the bottom plate 64 from the first wall 102, and may have a substantially rectangular, parallelepiped shape corresponding to the shape of the guide groove 125. A width of the slidable portion 113 in the sheet feeding direction may be less than the width of the guide groove 125 in the sheet feeding direction to reduce a sliding resistance of the slidable portion 113 to the guide groove 125. Thus, when the slidable portion 113 is inserted into the guide groove 125, there is a clearance between the slidable portion 113 and the guide groove 125.

Referring to FIGS. 12-14, the slidable portion 113 may comprise a plurality of protrusions, e.g., three protrusions 115-117. The protrusion 115 may protrude in a direction opposite to the sheet feeding direction, and the protrusions 116 and 117 may protrude in the sheet feeding direction. The protrusions 116 and 117 may be positioned on an upstream-side surface 118 of the slidable portion 113 in the sheet feeding direction, and the protrusion 115 may be positioned on a downstream-side surface (not shown) of the slidable portion 113 in the sheet feeding direction. The protrusions 116 and 117 may be separated from each other in the width direction of the main tray 61, such that the protrusions 116 and 117 are positioned at an outer position and an inner position, respectively.

Referring to FIGS. 13 and 14, the slidable portion 113 comprising the protrusions 115-117 may be inserted into the guide groove 125, such that the side guide 75 is supported to be slidable on the bottom plate 64 of the main tray 61. In this state, the protrusions 115-117 engage the respective bottom edges of the guide groove 125. Thus, the bottom plate 64 is held between the first wall 102 and the protrusions 115-117 of the side guide 75, and the bottom plate 64 retains some play. Because the slidable portion 113 of the side guide 75 is inserted into the guide groove 125 as described above, the side guide 75 may be slidably supported while the disengagement of the side guide 75 from the guide groove 125 may be prevented.

The rack member 120 may be connected to the side guide 75. The rack member 120 may comprise a synthetic resin, such as an ABS resin, similar to the side guide 75. The rack member 120 may be positioned on the underside of the first wall 102, and may extend from an inner end of the slidable portion 113 toward the middle of the main tray 61 in the width direction of the main tray 61. The rack member 120 may be positioned on the underside of the bottom plate 64 via the guide groove 125 when the slidable portion 113 is inserted into the guide grove 125.

The slide guide 130 may be positioned at a position corresponding to a side surface of the rack member 120, in which the side surface faces the upstream in the sheet feeding direction. Referring to FIG. 13, the slide guide 130 may comprise an elongated plate member, which extends in the width direction of the main tray 61 and protrudes from the underside of the bottom plate 64 to be perpendicular to a surface of the underside of the bottom plate 64. The slide guide 130 may have a side surface facing the downstream in the sheet feeding direction. When the rack member 120 moves in the width direction of the main tray 61 in response to the sliding of the side guide 75, the rack member 120 contacts and slides over the side surface of the slide guide 130. Thus, the rack member 120 is guided to the width direction, e.g., a second direction, of the main tray 61, such that the side surface of the slide guide 130 functions as a guide surface to guide the sliding of the rack member 120 in the width direction of the main tray 61.

The slide guide 130 may comprise a stopper 132. The stopper 132 may protrude from the side surface of the slide guide 130 to a movable range of the rack member 120. The stopper 132 is configured to regulate the range of movement of the rack member 120, e.g., to regulate an inward movement of the side guide 75 in the width direction of the main tray 61. An end of the rack member 120 contacts the stopper 132 when the side guide 75 slides inward in the width direction of the main tray 61, such that the further inward movement of the rack member 120 and the side guide 75 is restricted. The stopper 132 may be positioned at a position corresponding to a width of a standard photo sheet, e.g., about 89 mm.

The rack member 120 may comprise a rack 121. The rack 121 may be positioned at a side surface of the rack member 120 facing the pinion 128, e.g., at a side surface 124 of the rack member 120 (see FIG. 12) facing the downstream in the sheet feeding direction. The rack 121 is not shown in FIG. 12. The rack 121 and the pinion 128 may be positioned, such that teeth of the rack 121 and teeth of the pinion 128 smoothly engage each other, and a linear motion of the rack 121 smoothly is converted into a rotational motion of the pinion 128.

The side guide 76 and the side guide 75 may be substantially mirror images of each other. Similar to the side guide 75, the side guide 76 may comprise a substantially L-shaped member 101 and a slidable portion 114. The L-shaped member 101 may comprise a first wall 103, e.g., a bottom wall, and a second wall 105 that extends from an outer edge of the first wall 103 to be perpendicular to the first wall 103. The slidable portion 114 may comprise a plurality of protrusions, e.g., three protrusions 141-143 at positions corresponding to the protrusions 115-117, respectively, of the slidable portion 113. The protrusions 141-143 of the slidable portion 114 may be substantially similar to the protrusions 115-117. The side guide 76 further may comprise a rack member 122 having substantially the same structure as the rack member 121. The rack member 122 also may comprise a rack 123. The rack 123 may be positioned at a side surface of the rack member 122 facing the pinion 128, e.g., at a side surface (not shown) of the rack member 122 facing the upstream in the sheet feeding direction. The structures of the side guide 76 and the rack member 122 may be substantially the same as those of the side guide 75 and the rack member 121.

A slide guide 131 may be positioned at a position corresponding to a side surface of the rack member 122, in which the side surface faces the upstream in the sheet feeding direction. The slide guide 131 may have a substantially same structure as the slide guide 130. Referring to FIG. 13, the slide guide 131 may comprise an elongated plate member, which extends in the width direction of the main tray 61 and protrudes from the underside of the bottom plate 64 to be perpendicular to a surface of the underside of the bottom plate 64. The slide guide 131 may have a side surface 135 facing the upstream in the sheet feeding direction. When the rack member 122 moves in the width direction of the main tray 61 in response to the sliding of the side guide 76, the rack member 122 contacts and slides over the side surface 135 of the slide guide 131. Thus, the rack member 122 is guided to the width direction of the main tray 61, such that the side surface 135 of the slide guide 131 functions as a guide surface to guide the sliding of the rack member 122 in the width direction of the main tray 61.

In the main tray 61, the predetermined clearance may be formed between the slidable portion 113 and the guide groove 125 and between the slidable portion 114 and the guide groove 126 in order to ensure the smooth sliding of the side guides 75 and 76 or facilitate assembly of the side guides 75 and 76 to the main tray 61. Further, a predetermined amount of clearance may be formed between each of the racks 121 and 123 and the pinion 128 to ensure a smooth motion therebetween. Nevertheless, the slidable portions 113 and 114, and the racks 121 and 123, and by extension, the side guides 75 and 76, may rattle due to the clearances formed between the slidable portion 113 and the guide groove 125, between the slidable portion 114 and the guide groove 126, and between each of the racks 121 and 123 and the pinion 128. More specifically, the side guides 75 and 76 may rattle in a direction that the side guides 75 and 76 rotate about the respective slidable portions 113 and 114 due to the clearances.

If the side guides 75 and 76 tilt with respect to the sheet feeding direction due to the rattling of the side guides 75 and 76, a recording sheet being fed is skewed with respect to the sheet feeding direction. The skewing of the recording sheet may be corrected by the registration operation. Nevertheless, a center of the recording sheet in its width direction is shifted from a reference position, such that an image to be recorded on the recording sheet may be displaced in the sheet width direction. Particularly, if the clearance between each of the side guides 75 and 76 and the pinion 128 decreases, a rotational angle of the side guides 75 and 76 rotating about the pinion 128 increases, such that the side guides 75 and 76 may rattle greatly, which decreases image quality.

If the clearance between the slidable portion 113 and the guide groove 125 and the clearance between the slidable portion 114 and the guide groove 126 are minimized, such that the slidable portions 113 and 114 and the pinion 128 do not significantly rattle, the rattling of the side guides 75 and 76 may be restricted. Nevertheless, a sliding resistance or an engaging resistance of the side guides 75 and 76 may increase, such that the operability of the side guides 75 and 76 may substantially decrease.

Referring to FIGS. 13 and 14, a guide piece 136 may be positioned between the side guide 76 and the slide guide 131. More specifically, the guide piece 136 may be positioned on the side surface 135 of the slide guide 131 corresponding to the side guide 76, and at a position adjacent to the stopper 133 and closer to the pinion 128 than the stopper 133. The guide piece 136 may protrude from the side surface 135 toward the upstream in the sheet feeding direction. An amount which the guide piece 136 protrudes from the side surface 135 substantially may be determined in accordance with the degree of rattling of the side guide 76.

The guide piece 136 may have a slope 138 with a predetermined amount of incline. The slope 138 extends from a top 137 of the guide piece 136 to the side surface 135 toward the pinion 128.

Figure 15A:
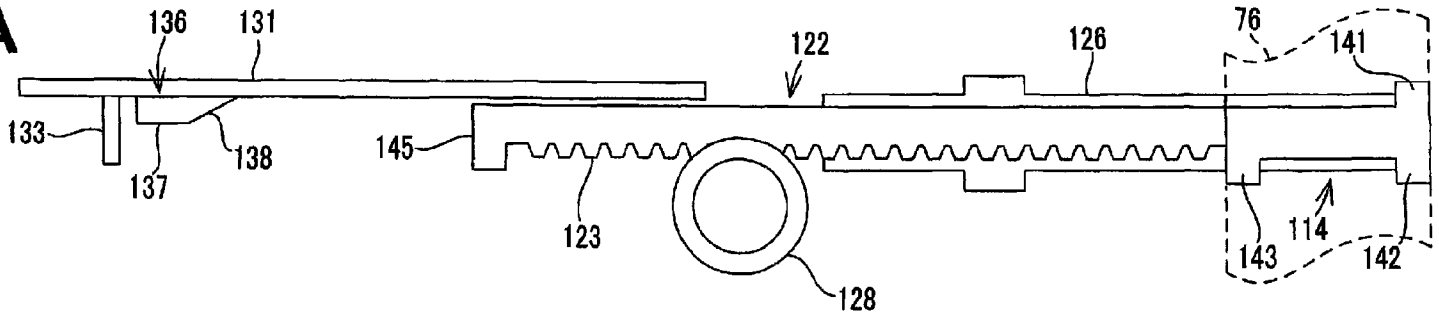
FIGS. 15A-15C depict various states of a rack member.
Figure 15B:
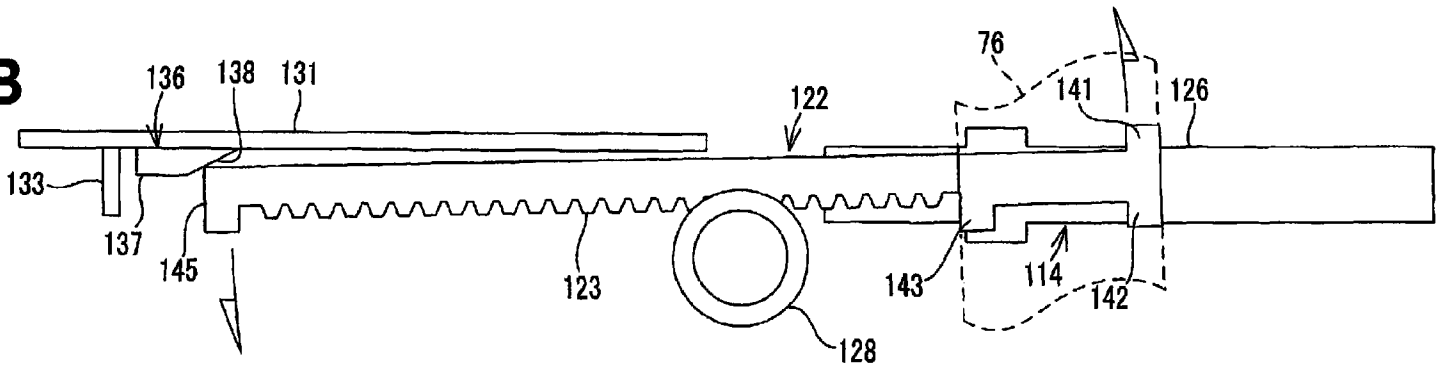
Figure 15C:
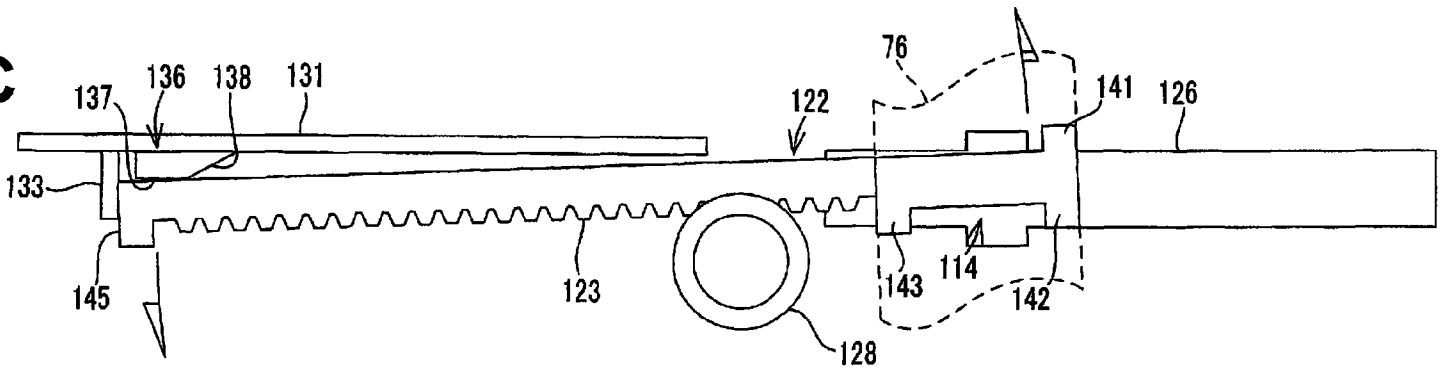
Figure 16:
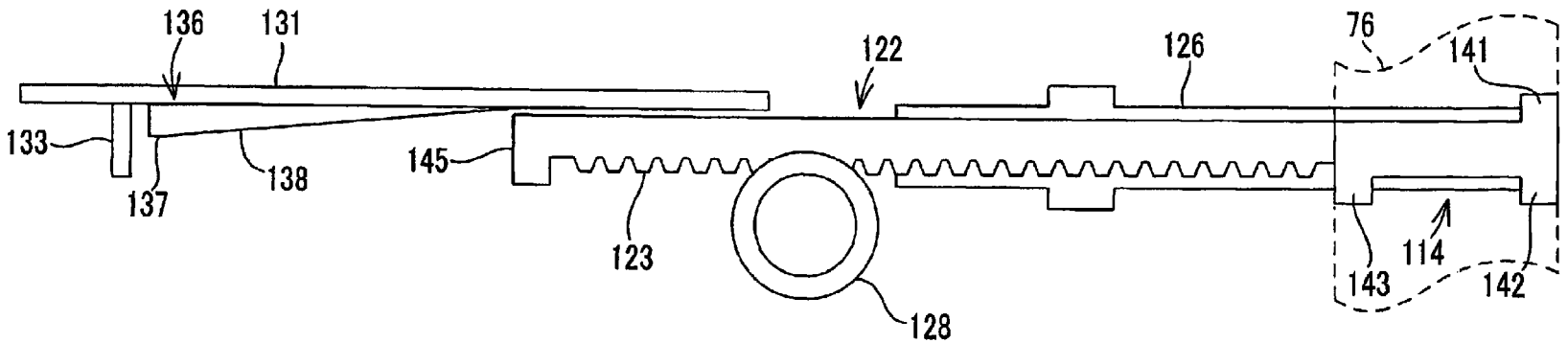
FIG. 16 shows a guide piece connected to the rack member, according to another embodiment of the present invention.

The movement of the rack member 122 and the operations of the guide piece 136 now are described with reference to FIGS. 15A-15C. In FIGS. 15A-15C, the rack member 120, the guide groove 125, and the slide guide 130 are omitted from the drawings. A topside of the drawing sheet is defined as the downstream in the sheet feeding direction.

FIG. 15A shows a positional relationship between the side guide 76 and the pinion 128, in which the side guide 76 is located at a first position at which the side guide 76 is located at a farthest position from the pinion 128. The first position may be a position corresponding to a position of one side edge of an A4-size recording sheet in the sheet width direction when the recording sheet is positioned on the main tray 61. When the side guide 76 slides from the first position toward the pinion 128 and moves closer to, e.g., in the neighborhood of, a second position at which the side guide 76 is located at a nearest position from the pinion 128, an end 145 of the rack member 122 contacts the slope 138 of the guide piece 136 (FIG. 15B). The second position may be a position corresponding to a position of one side edge of a recording sheet, which is a minimum recording sheet that may be fed by the sheet feeding mechanism 33, e.g., a standard photo sheet, in the sheet width direction.

While the side guide 76 further slides to the second position, the end 145 of the rack member 122 is guided to the top 137 of the guide piece 136 along the slope 138. Then, the end 145 of the rack member 122 contacts the stopper 133 and the side guide 76 is located at the second position (see FIG. 15C). At that time, the end 145 of the rack member 122 is urged toward the upstream in the sheet feeding direction by the guide piece 136.

The rack 123 of the rack member 122 is pressed against the pinion 128, by which the end 145 of the rack member 122 is urged toward the upstream in the sheet feeding direction. Thus, a backlash between the rack 123 and the pinion 128 is minimized. At that time, depending on the material which the rack member 122 comprises, e.g., a resin having flexibility, the rack member 122 is deformed toward the upstream in the sheet feeding direction. Because the rack member 122 is deformed as described above, the rack member 122 does not crack if the protruding amount of the guide piece 136 is greater with respect to the rattling of the side guide 76. The engaging resistance between the rack 123 and the pinion 128 increases, by which the rack 123 is pressed against the pinion 128.

The rack member 122 receives a force that acts in a direction that the rack member 122 rotates in a counterclockwise direction about the engaging point of the rack 123 and the pinion 128, by which the end 145 of the rack member 122 is urged toward the upstream in the sheet feeding direction (see FIGS. 15B and 15C). Thus, the slidable portion 114 positioned at the opposite side of the rack member 122 to the end 145 is urged toward the downstream in the sheet feeding direction, e.g., upward in FIG. 15, and is pressed against the edge of the guide groove 126. Consequently, the rattling of the slidable portion 114 in the guide groove 126 may be minimized. At that time, the side guide 76 tilts, such that its downstream end in the sheet feeding direction points toward the middle of the main tray 61 in the width direction of the main tray 61. The engaging resistance between the slidable portion 114 and the guide groove 126 increases, by which the slidable portion 114 is pressed against the edge of the guide groove 126.

Because the guide piece 136 may be positioned on the slide guide 131, the end 145 of the rack member 122 is urged toward the upstream in the sheet feeding direction and the slidable portion 114 is pressed against the edge of the guide groove 126 when the side guide 76 is located at the second position. Thus, the rattling of the rack member 122 and the slidable portion 114 may be minimized regardless of the presence or absence of the clearance between the rack and the pinion 128 or the clearance between the slidable portion 114 and the guide groove 126. Consequently, the rattling of the side guide 76 may be minimized. When a recording sheet is fed in this state, a side edge of the recording sheet in the sheet width direction reliably is supported by the side guide 76, such that the skewing of the recording sheet may be restricted. Consequently, the displacement of an image to be recorded on the recording sheet may be prevented.

The side guide 76 smoothly slides until the side guide 76 reaches the neighborhood of the second position, e.g., before the end 145 of the rack member 122 contacts the guide piece 136. The smoothness of the movement of the side guide 76 deteriorates after the end 145 of the rack member 122 contacts the guide piece 136. This phenomenon only may occur immediately before the sliding motion of the side guide 76 is stopped by the stopper 133. Therefore, this phenomenon does not exert an influence upon the operability of the side guide 76.

As described above, the end 145 of the rack member 122 is urged toward the upstream in the sheet feeding direction, and the slidable portion 114 of the rack member 122 is urged toward the downstream in the sheet feeding direction, such that the side guide 76 tilts, such that its downstream end in the sheet feeding direction points to a direction more inward with respect to the width direction of the main tray 61 than its upstream end in the sheet feeding direction. Thus, the side guide 76 may restrict a side edge of a recording sheet in the sheet width direction, and reliably may guide the recording sheet without skewing the recording sheet in the sheet feeding direction until the recording sheet completely enters the sheet conveying path 23.

Because the guide piece 136 may have the slope 138, the end 145 of the rack member 122 readily may be guided to the top 137 of the guide piece 136. Further, the side guide 76 smoothly may slide over the slope 138 after the end 145 of the rack member 122 contacts the guide piece 136 and reaches the top 137 of the guide piece 136. Alternatively, referring to FIG. 16, a guide piece 136 may have a slope 138 with a gentle incline that extends across a movable range of the end 145 of the rack member 122. The movement of the side guide 76 becomes smoother as the inclination angle of the slope 138 becomes more gentle.

As described above, the guide piece 136 is positioned adjacent to the stopper 133. Nevertheless, the installation position of the guide piece 136 is not limited to this embodiment. The guide piece 136 may be positioned at a predetermined position closer to the pinion 128 than at least the first position. The second position may be the position corresponding to a side edge of a minimum recording sheet that may be fed by the sheet feeding mechanism 33. The guide piece 136 may be configured to handle any sheets with the size that is less than or equal to a predetermined size sheet.

The mechanism configured to urge the rack member 122 by the guide piece 136 may be applied to a mechanism configured to slide the side guides 95 and 96 of the second tray 62. A multifunction device, which may comprise a document tray on which a document may be placed and an automatic document feeder that feeds the document to an image reading position from the document tray, may comprise a pair of side guides having the same structure as the side guides 75 and 76 at the document tray. The mechanism configured to urge a rack member having the same structure as the rack member 122 by a guide piece having the same structure as the guide piece 136 may be applied to the pair of side guides of the general multifunction device.

Figure 17A:
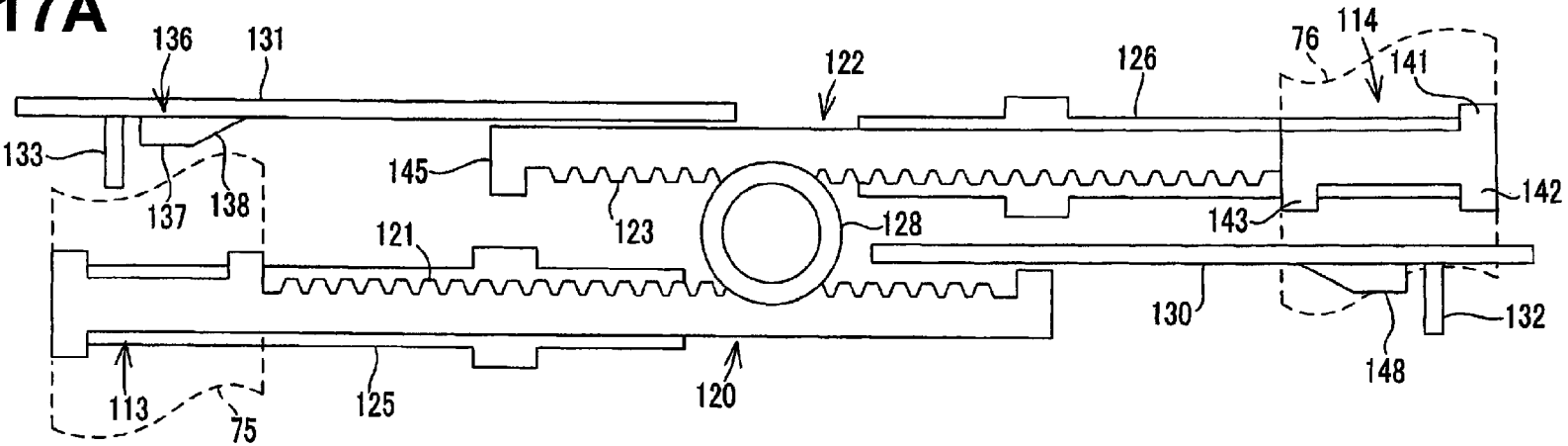
FIGS. 17A and 17B depict various states of rack members, according to yet a another embodiment of the present invention.
Figure 17B:
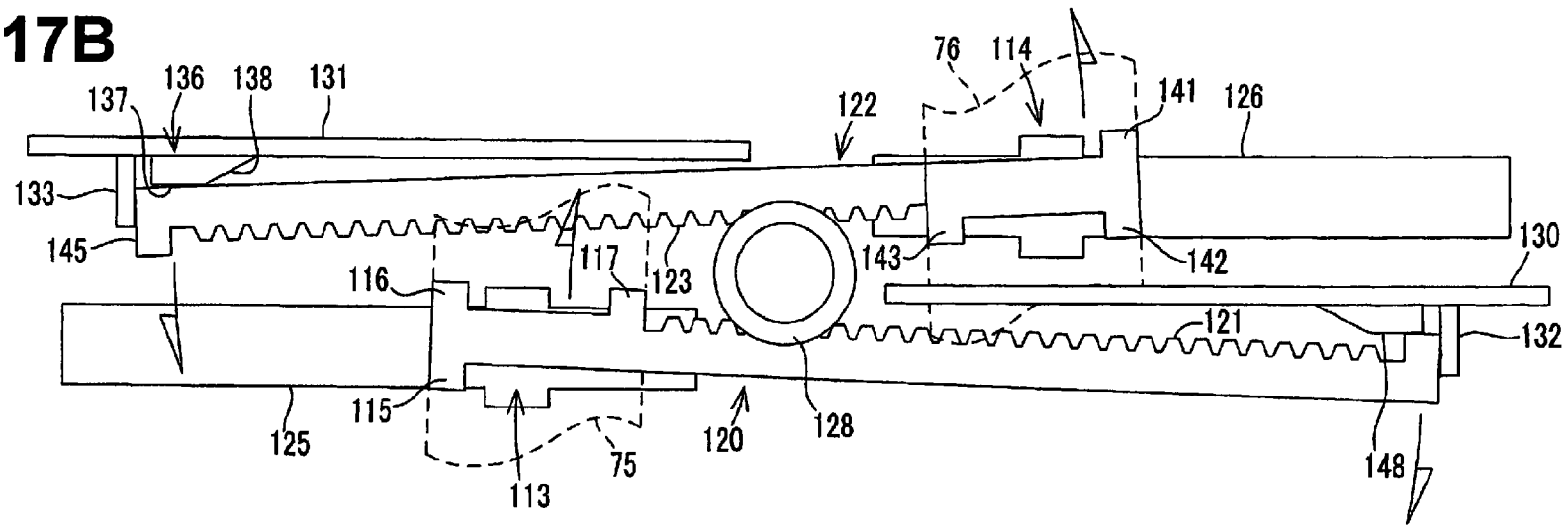

Another embodiment of the present invention now is described with reference to FIGS. 17A and 17B. FIGS. 17A and 17B show an underside of a main tray 61.

The slide guide 131 may be positioned with the guide piece 136. Alternatively, referring to FIGS. 17A and 17B, a slide guide 130 may be positioned facing a rack 121 to urge a rack member 120 toward the upstream in the sheet feeding direction. A guide piece 148 having the substantially the same structure as the guide piece 136 may be connected to the slide guide 130. With this structure, the rattling of the side guides 75 and 76 is minimized when the side guides 75 and 76 slide to the second position.

The side guides 75 and 76 tilt, such that their downstream ends in the sheet feeding direction point to a direction more inward with respect to the width direction of the main tray 61 than their upstream ends in the sheet feeding direction. Thus, an area defined by the side guides 75 and 76 becomes narrower toward the downstream in the sheet feeding direction. With this structure, a recording sheet reliably may be guided in the sheet feeding direction until a trailing edge of the recording sheet enters the sheet conveying path 23.

Figure 18A:
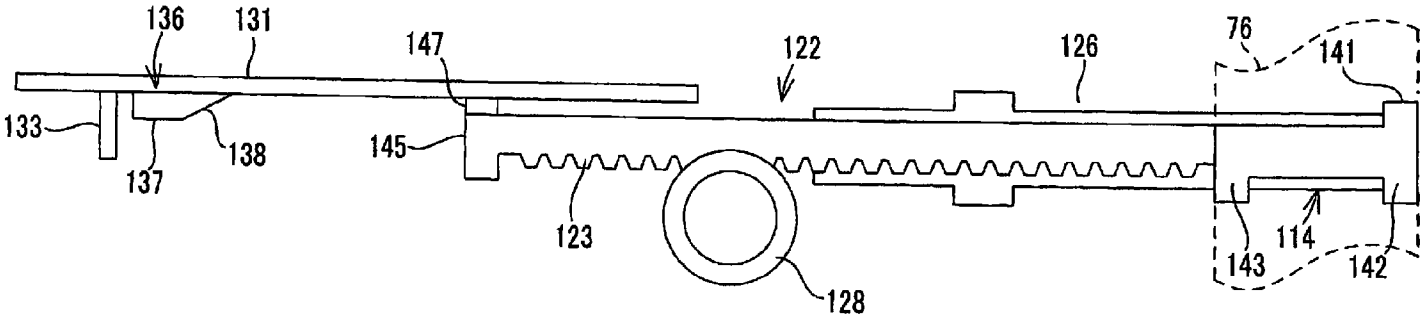
FIGS. 18A-18C illustrate various states of a rack member, according to still yet another embodiment of the present invention.
Figure 18B:
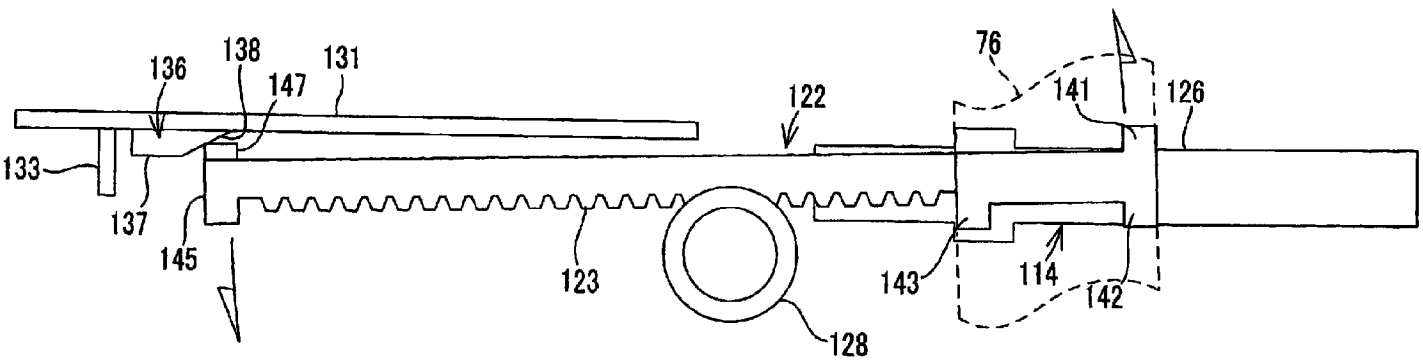
Figure 18C:
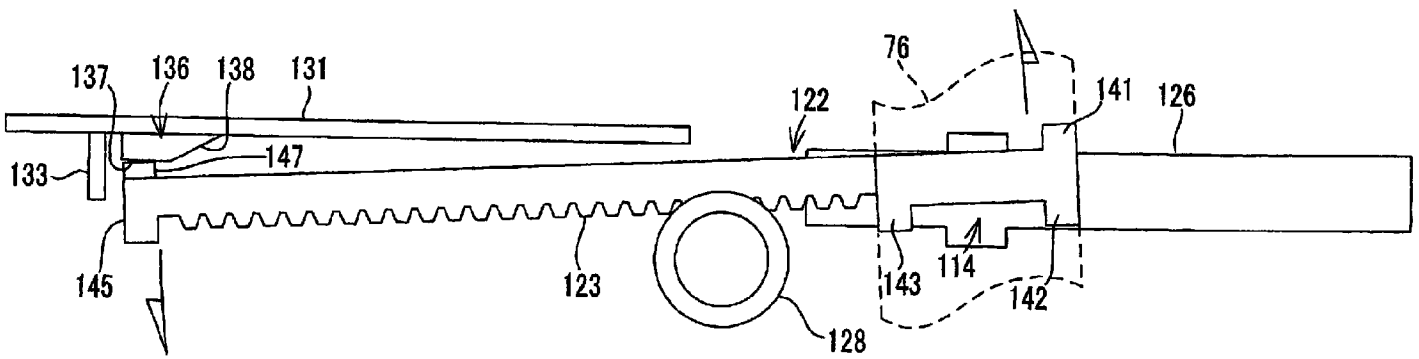

Yet another embodiment of the present invention now is described with reference to FIGS. 18A-18C. FIGS. 18A-18C show an underside of a main tray 61.

In addition to the side guide 136 and the slide guide 131, an end 145 of a rack member 122 may comprise a projection 147 positioned on a surface of the rack member 122 facing the slide guide 131. The end 145 of the rack member 122 is urged toward the upstream in the sheet feeding direction by the contact of the guide piece 136 and the projection 147.

While the invention may have been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. A guide device comprising:

a side guide positioned at a tray, wherein the tray is configured to receive a sheet, and the side guide is configured to guide the sheet in a first direction corresponding to a sheet feeding direction;

a sliding mechanism configured to support the side guide and to slide the side guide between a first position and a second position in a second direction substantially perpendicular to the first direction;

a pinion rotatably positioned at the tray, wherein when the side guide is in the first position a distance between the side guide and the pinion is a maximum distance therebetween, and when the side guide is in the second position a distance between the side guide and the pinion is a minimum distance therebetween;

a rack member, wherein the rack member is connected to the side guide, extends from the side guide toward a middle of the tray in the second direction, and comprises a rack which engages the pinion, wherein the rack member is configured to move in the second direction in response to a sliding of the side guide;

a slide guide positioned at the tray, wherein the slide guide is configured to guide the rack member when the rack member moves in the second direction; and an urging member positioned between the rack member and the slide guide facing the rack member, wherein the urging member is configured to urge the rack member in the first direction when the side guide is at a predetermined position which is closer to the pinion than the first position, wherein the urging member protrudes toward the rack member from a guide surface of the slide guide facing the rack member, and wherein the urging member is configured to guide the rack member when the side guide moves in the second direction between the second position and the predetermined position.

2. The guide device of claim 1, wherein the second position is the predetermined position.

3. The guide device of claim 1, wherein the urging member comprises an inclined surface that extends from a top of the urging member to the guide surface of the slide guide.

4. The guide device of claim 3, wherein the urging member comprises the inclined surface and a horizontal surface.

5. The guide device of claim 1, wherein the sliding mechanism is further configured to slide the side guide between the second position and the first position along the second direction.

6. The guide device of claim 1, wherein the urging member is integrally formed on the slide guide.

7. The guide device of claim 1, wherein the urging member is configured to urge an end of the rack member opposite another end of the rack member connected to the side guide in the first direction when the side guide is at the predetermined position.

8. An image processing apparatus, comprising:

a tray configured to receive a sheet;

a sheet feeding mechanism configured to feed the sheet in a first direction to the tray, wherein the first direction corresponds to a sheet feeding direction; and a guide device positioned at the tray, wherein the guide device comprises:

a side guide positioned at the tray, wherein the side guide is configured to guide the sheet in the first direction;

a sliding mechanism configured to support the side guide and to slide the side guide between a first position and a second position in a second direction substantially perpendicular to the first direction;

a pinion rotatably positioned at the tray, wherein when the side guide is in the first position a distance between the side guide and the pinion is a maximum distance therebetween, and when the side guide is in the second position a distance between the side guide and the pinion is a minimum distance therebetween;

a rack member, wherein the rack member is connected to the side guide, extends from the side guide toward a middle of the tray in the second direction, and comprises a rack which engages the pinion, wherein the rack member is configured to move in the second direction in response to a sliding of the side guide;

a slide guide positioned at the tray, wherein the slide guide is configured to guide the rack member when the rack member moves in the second direction; and an urging member positioned between the rack member and the slide guide facing the rack member, wherein the urging member is configured to urge the rack member in the first direction when the side guide is at a predetermined position which is closer to the pinion than the first position, wherein the urging member protrudes toward the rack member from a guide surface of the slide guide facing the rack member, and wherein the urging member is configured to guide the rack member when the side guide moves in the second direction between the second position and the predetermined position.

9. The image processing apparatus of claim 8, further comprising a recording device configured to record an image onto the sheet.

10. The image processing apparatus of claim 8, further comprising a reading device configured to read an image from the sheet.

11. The image processing apparatus of claim 8, wherein the urging member is integrally formed on the slide guide.

* * * * *